US010781067B2

(12) United States Patent
Smith et al.

(10) Patent No.: US 10,781,067 B2
(45) Date of Patent: Sep. 22, 2020

(54) SLIDE CUTTER BOX

(71) Applicant: REYNOLDS CONSUMER PRODUCTS LLC, Lake Forest, IL (US)

(72) Inventors: Amy Frances Smith, Chicago, IL (US); Yashpal Rajendra Kamire, Vernon Hills, IL (US); James S. Blythe, Libertyville, IL (US); Neema Pourian, Chicago, IL (US); Zachary J. McIntosh, Chicago, IL (US); Katherine A. Reiser, Mount Prospect, IL (US); José L. Padilla, Chicago, IL (US)

(73) Assignee: REYNOLDS CONSUMER PRODUCTS LLC, Lake Forest, IL (US)

( * ) Notice: Subject to any disclaimer, the term of this patent is extended or adjusted under 35 U.S.C. 154(b) by 115 days.

(21) Appl. No.: 15/722,575

(22) Filed: Oct. 2, 2017

(65) Prior Publication Data

US 2018/0305164 A1 Oct. 25, 2018

Related U.S. Application Data

(60) Provisional application No. 62/488,023, filed on Apr. 20, 2017.

(51) Int. Cl.
*B26D 1/04* (2006.01)
*B65H 35/00* (2006.01)
(Continued)

(52) U.S. Cl.
CPC ..... *B65H 35/008* (2013.01); *B26D 1/045* (2013.01); *B65D 83/0864* (2013.01);
(Continued)

(58) Field of Classification Search
CPC .. B65H 35/008; B65H 35/0086; B26D 1/045; B65D 83/0864; B65D 83/0882
See application file for complete search history.

(56) References Cited

U.S. PATENT DOCUMENTS 1,559,239 A * 10/1925 Fox ..... B65D 5/36 229/117.04
2,334,997 A * 11/1943 Doll ..... B65D 83/0847 225/49

(Continued)

*Primary Examiner* — Andrea L Wellington
*Assistant Examiner* — Liang Dong
(74) *Attorney, Agent, or Firm* — Baker Botts L.L.P.

(57) ABSTRACT

Container having a base portion defining a compartment and a lid portion moveable between an open position for access to the compartment and a closed position to cover the compartment. The base portion includes a bottom panel, a back panel extending from the bottom panel to a back panel upper edge, and back side tabs extending from the back panel and defining opposing sides of the base portion. The base portion further includes a front base panel extending upwardly from the bottom panel to a front angle panel, the front angle panel extending upwardly and inwardly from the front base panel to a free end. The lid portion is hingedly-coupled to the upper edge of the back panel. The container further includes a cutter disposed on the front angle panel. A blank and method for forming the container from a sheet of blank material is also provided.

19 Claims, 25 Drawing Sheets

(51) Int. Cl.
*B65D 83/08* (2006.01)
*B65D 85/671* (2006.01)

(52) U.S. Cl.
CPC ..... *B65D 83/0882* (2013.01); *B65H 35/0086* (2013.01); *B65D 85/671* (2013.01); *B65H 2301/51512* (2013.01); *B65H 2402/441* (2013.01)

(56) References Cited

U.S. PATENT DOCUMENTS 2,373,730 A * 4/1945 Williamson ..... B65D 5/22 229/125.26
3,118,581 A * 1/1964 Finke ..... B65D 83/0882 225/39
RE25,876 E * 10/1965 Buttery ..... B65D 83/0882 206/395
3,549,081 A * 12/1970 Nelson ..... B65D 5/10 229/117
3,722,767 A * 3/1973 Struble ..... B65D 83/0882 225/49
4,787,284 A 11/1988 Chen
5,275,321 A 1/1994 Manu et al.
6,564,942 B1 5/2003 Shiffler et al.
7,000,520 B2 2/2006 Nichols et al.
7,603,937 B2 * 10/2009 Pavlik ..... B26D 1/045 83/614
7,918,151 B2 4/2011 Vegliante et al.
7,921,756 B2 4/2011 Vegliante et al.
8,763,887 B2 * 7/2014 Nieto ..... B65D 5/029 229/109
2002/0117038 A1 8/2002 Vegliante et al.
2005/0166738 A1 8/2005 Hsu
2007/0022857 A1 2/2007 Schreiter
2011/0209594 A1 9/2011 Withers

* cited by examiner

SLIDE CUTTER BOX

CLAIM OF PRIORITY

The present application claims priority to U.S. Provisional Application No. 62/488,023 filed on Apr. 20, 2017, the content of which is hereby incorporated by reference into this application.

BACKGROUND

Field of the Disclosed Subject Matter

The disclosed subject matter relates to a container for storing and dispensing a film or sheet material packaged on a roll, such as plastic film wrap or other such products.

DESCRIPTION OF RELATED ART

Various film or sheet type products are available in roll form, such as products used to cover or wrap items. For example, plastic film wrap is often used to adhere to and cover a perishable item, or to the sides of an open container containing the perishable item. The properties of the plastic film wrap can be provided with performance properties, such as elasticity and adhesion characteristics, to provide an air tight seal about the perishable item or opening of the container.

A variety of dispensing containers are known to hold rolls of film or sheet material, such as plastic film wrap, wax paper, parchment paper, aluminum foil, and the like. Such dispensing containers can be provided with a sharp and/or serrated edge to allow a user to cut the material with the edge. However, conventional dispensing containers generally are not configured to secure a film roll therein. Furthermore, properties of certain films, such as plastic wrap, can cause undesirable effects, such as stretching or clumping of the plastic wrap before used for its intended purpose.

It is therefore desirable to provide a dispensing container for a roll of film or sheet material that securely contains the roll therein and allows for easy dispensing and cutting of the film or sheet material.

Additionally, it is desirable to provide a single folded blank for forming such a dispensing container, which can reduce manufacturing complexity, as well as the number of components and costs associated with manufacture of the dispensing container.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter provides a container having a cutter, as well as a blank for forming the container.

As embodied herein, a container of the disclosed subject matter includes a base portion defining a compartment and a lid portion moveable between an open position for access to the compartment and a closed position to cover the compartment. The base portion includes a bottom panel defining a bottom of the compartment. A front base panel extends upwardly from the bottom panel to a front angle panel, the front angle panel extends upwardly and inwardly from the front base panel to a free end. A back panel extends from the bottom panel to a back panel upper edge. First and second back side tabs extend from the back panel and define opposing sides of the base portion.

Additionally, and further to the above, the container of the disclosed subject matter includes a lid portion. The lid portion includes a top panel defining a top of the lid portion, and the top panel is hingedly-coupled to the upper edge of the back panel. A front lid panel extends downwardly from the top panel when the lid is in the closed position to a lid free end. First and second top side panels extend from the top panel and define opposing sides of the lid portion. The container further includes a cutter disposed on the front angle panel.

Additionally or alternatively, and as embodied herein, the first and second back side tabs can each have a front edge and a chamfered corner. The chamfered corner can be at angle of 10° to 90° relative to the front edge of the back side tab. The chamfered corner can be at angle of 45° relative to the front edge of the back side tab. The chamfered corner of each back side tab can engage the front angle panel. A roll of product can be contained within the compartment. The front angle panel can be configured to retain the roll within the compartment. End locks can extend at least partially into the compartment from opposing sides of the base portion, wherein the end locks can be configured to engage the inside of the roll and retain the roll within the compartment. The front angle panel can include at least one cut out corner for access to the product within the compartment. The front angle panel can include an intermediate portion disposed between the cutter and the free end, and wherein the intermediate portion can be joined proximate opposing ends thereof to the opposing sides of the base portion. In the closed position, the cutter can be disposed within a recess defined by the lid portion. The cutter can include a track and a sliding member, wherein the track can define a channel, and wherein the sliding member can be configured to slide within the channel of the track.

Additionally or alternatively, and as embodied herein, the sliding member can include a lower portion sized to be disposed at least partially within the channel of the track, and wherein the lower portion has a rectangular shape. The track can include a detent and an end stop disposed within the channel, and wherein the detent is configured to inhibit or prevent movement of the sliding member along the track. The track can include an end stop disposed at least partially within the channel, and wherein the end stop is configured to inhibit or prevent movement of the sliding member along the track beyond the end stop. The track can include an upper surface with an adhesive coating disposed thereon, and wherein the adhesive coating is configured to releasably adhere to a sheet of a product removed from the compartment and disposed proximate the adhesive coating. The container can further include a frangible sticker coupled to the front lid panel and the front panel, wherein the frangible sticker includes a perforation along its length, wherein in a first condition, the frangible sticker is configured to form a connection between the front lid panel and the front base panel with the lid portion in the closed position, and in a second condition, the frangible sticker is configured to allow the lid portion to be more toward the open position.

According to another aspect of the disclosed subject matter, and further to the above, container formed from a blank is provided. As embodied herein, the container of the disclosed subject matter includes a bottom portion having a bottom panel including opposing first and second bottom end fold lines. A front base panel extends from the first bottom end fold line to a front fold line. A front angle panel extends from the front fold line to a front angle free end. A back panel extends from the second bottom end fold line to a base-lid hinge line, the back panel having opposing first and second back side fold lines. First and second back side tabs extend from the first and second back side fold lines, respectively, to a first and second back side edge, each back side tab having a chamfered corner.

Additionally, and further to the above, the container of the disclosed subject matter includes a lid portion having a top panel extending from the base-lid hinge line to a top front fold line, the top panel having opposing first and second top side fold lines. A front lid panel extends from the top front fold line to a lid free end, and first and second top side panels extend from the first and second top side fold lines, respectively, to a first and second top side edge.

According to another aspect of the disclosed subject matter, and further to the above, a blank is provided. As embodied herein, the blank of the disclosed subject matter includes a bottom portion having a bottom panel including opposing first and second bottom end fold lines. A front base panel extends from the first bottom end fold line to a front fold line. A front angle panel extends from the front fold line to a front angle free end. A back panel extends from the second bottom end fold line to a base-lid hinge line, the back panel having opposing first and second back side fold lines. First and second back side tabs extend from the first and second back side fold lines, respectively, to a first and second back side edge, each back side tab having a chamfered corner.

Additionally, and further to the above, the blank of the disclosed subject matter includes a lid portion having a top panel extending from the base-lid hinge line to a top front fold line, the top panel having opposing first and second top side fold lines. A front lid panel extends from the top front fold line to a lid free end, and first and second top side panels extend from the first and second top side fold lines, respectively, to a first and second top side edge.

Additionally, or alternatively, and as embodied herein, the base-lid hinge line can include score lines along its length. The front fold line can include score lines along its length. The blank can be formed from a cardstock material having a weight of about 350-400 grams per square meter. The lid free end can include a front lid end tab extending from a lid free end fold line opposite the top front fold line to a front lid end tab outer edge, wherein the front lid end tab is configured to fold onto the front lid panel. The front angle free end can include a front angle end tab extending from a front angle fold line opposite the front fold line to a front angle end tab outer edge, wherein the front angle end tab is configured to fold onto the front angle panel at the front angle fold line. The front angle panel can include opposing first and second front angle side fold lines, wherein the blank further includes first and second front angle side tabs extending from the first and second front angle side fold lines, respectively, to a first and second front angle side edge.

Additionally, or alternatively, and as embodied herein, the front base panel can include opposing first and second front side fold lines, wherein the blank further includes first and second front side tabs extending from the first and second front side fold lines, respectively, to a first and second front side edge. The bottom panel can include opposing first and second bottom side fold lines, wherein the blank further includes first and second bottom side panel extending from the first and second bottom side fold lines, respectively, to a first and second bottom side edge. The front lid panel includes opposing first and second front lid side fold lines, wherein the blank further includes first and second front lid side tabs extending from the first and second front lid side fold lines, respectively, to a first and second front lid side edge.

The blank can include any or all of the features described herein.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the disclosed subject matter. Together with the description, the drawings serve to explain the principles of the disclosed subject matter.

DETAILED DESCRIPTION

Figure 1:
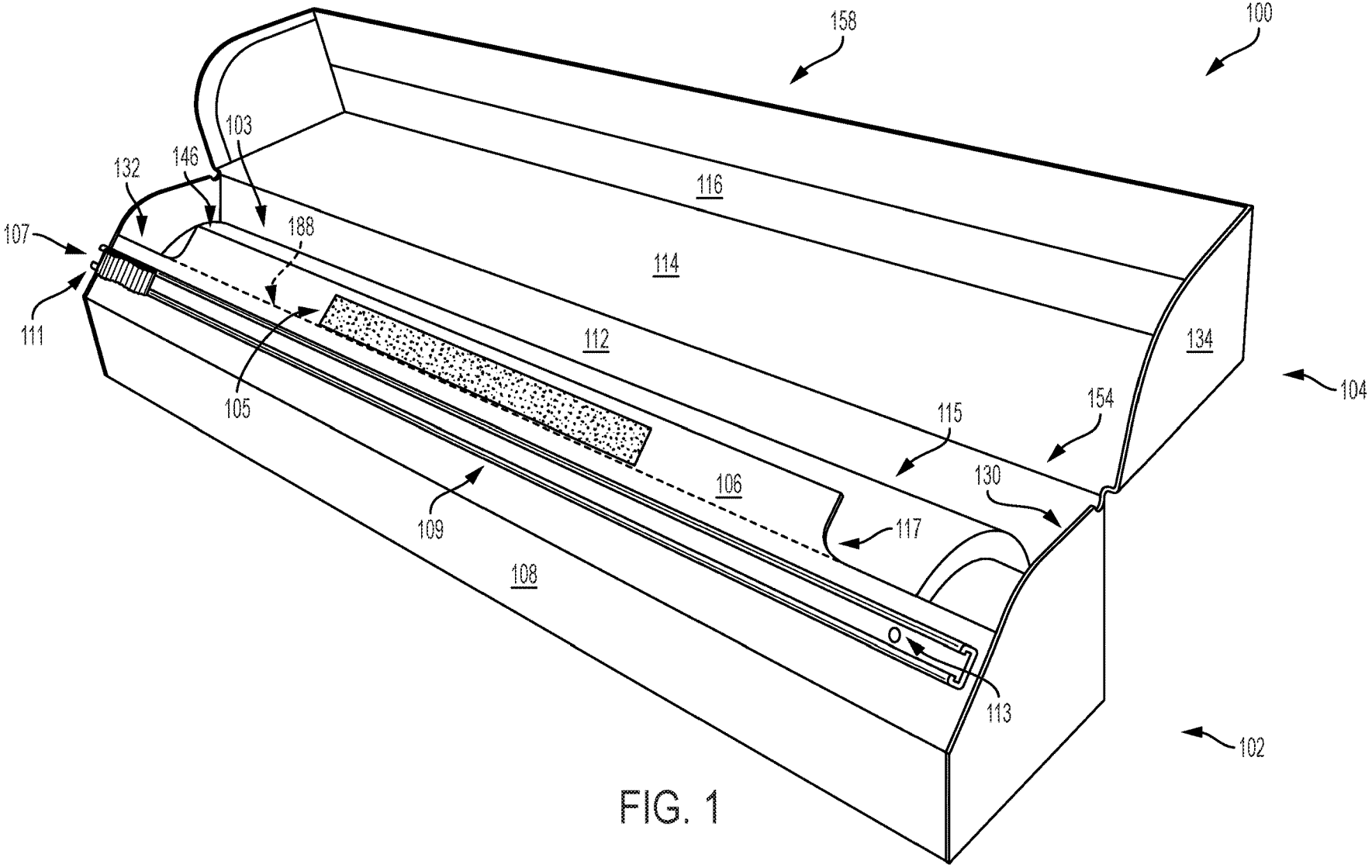
FIG. 1 is a front, right perspective view of an embodiment of a container in accordance with the disclosed subject matter, shown with the lid in the open position.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein can be used to dispense, store, and transport a film or sheet material on a roll, such as plastic film wrap. The disclosed subject matter is particularly suited for storing and dispensing product wherein the container can move between a closed position, in which the product is enclosed for safe transport and storage, and an open position, in which the product can be dispensed from the container in an easy, effective, and intuitive manner.

Particularly, the disclosed subject matter is directed to a container for storing and dispensing a film or sheet material on a roll, wherein the container has a base portion defining a compartment to contain the product and a lid portion moveable between open and closed positions. The container includes an angled panel with a slide cutter disposed thereon. The angled panel can substantially secure the roll of film or sheet material within the compartment, while still allowing easy access to the roll.

The accompanying figures, where like reference numerals refer to identical or functionally similar elements throughout separate views, serve to further illustrate various embodiments and to explain various principles and advantages all in accordance with the disclosed subject matter. For purpose of explanation and illustration, and not limitation, exemplary embodiments of the container, as well as a blank and various methods for forming the container in accordance with the disclosed subject matter, are shown in FIGS. 1-30. The container is suitable for use with a wide variety of products packaged on a roll, including but not limited to paper, aluminum, tape, plastic, and fabric. For example, the container disclosed herein is suitable and beneficial for use with a material to be dispensed in thin sheets, such as plastic film wrap, wax paper, parchment paper, aluminum foil, and the like.

For purpose of illustration, and not limitation, reference will be made to a container, or dispensing container, for a rolled product. As used herein, the terms "front," "end," "side," "top," and "bottom" are used for the purpose of illustration only, and not limitation. That is, it is recognizable that the terms "front," "end," "side," "top," and "bottom" are interchangeable and are merely used herein as a point of reference. Additionally, as used herein, the term "score line" includes a line incised or otherwise cut into, either partially or entirely through, the surface of the container or the blank used to form the container of the disclosed subject matter, and the term "fold line" includes a line of weakness or bending formed in the surface of the container or the blank used to form the container of the disclosed subject matter.

In accordance with the disclosed subject matter, a container is provided generally including a base portion defining a compartment and a lid portion moveable between an open position for access to the compartment and a closed position to cover the compartment. The base portion includes a bottom panel defining a bottom of the compartment. A front base panel extends upwardly from the bottom panel to a front angle panel, the front angle panel extends upwardly and inwardly from the front base panel to a free end. A back panel extends from the bottom panel to a back panel upper edge. First and second back side tabs extend from the back panel and define opposing sides of the base portion. Furthermore, the container includes a cutter disposed on the front angle panel.

Additionally, and further to the above, the container of the disclosed subject matter includes a lid portion. The lid portion includes a top panel defining a top of the lid portion, and the top panel is hingedly-coupled to the upper edge of the back panel. A front lid panel extends downwardly from the top panel when the lid is in the closed position to a lid free end. First and second top side panels extend from the top panel and define opposing sides of the lid portion.

For the purpose of illustration, and not limitation, reference is made to the exemplary container 100 shown in exemplary FIGS. 1-18. Additionally, for purpose of understanding, reference is made in conjunction to the blank 200 of FIG. 19, which can be used to form the container 100 of exemplary FIGS. 1-18.

As embodied herein, and with reference to FIGS. 1-8, the container 100 generally includes a base portion 102 defining a compartment 103 and a lid portion 104. The lid portion 104 can be moveable between an open position for access to the compartment 103 and a closed position to cover the compartment 103.

The base portion 102 generally includes a bottom panel 110 defining a bottom of the compartment 103 to hold a roll 115 of film or sheet material (e.g., a roll of plastic film wrap) therein and a front base panel 108 extending upwardly from the bottom panel 110 and defining a front of the compartment 103.

Figure 8:
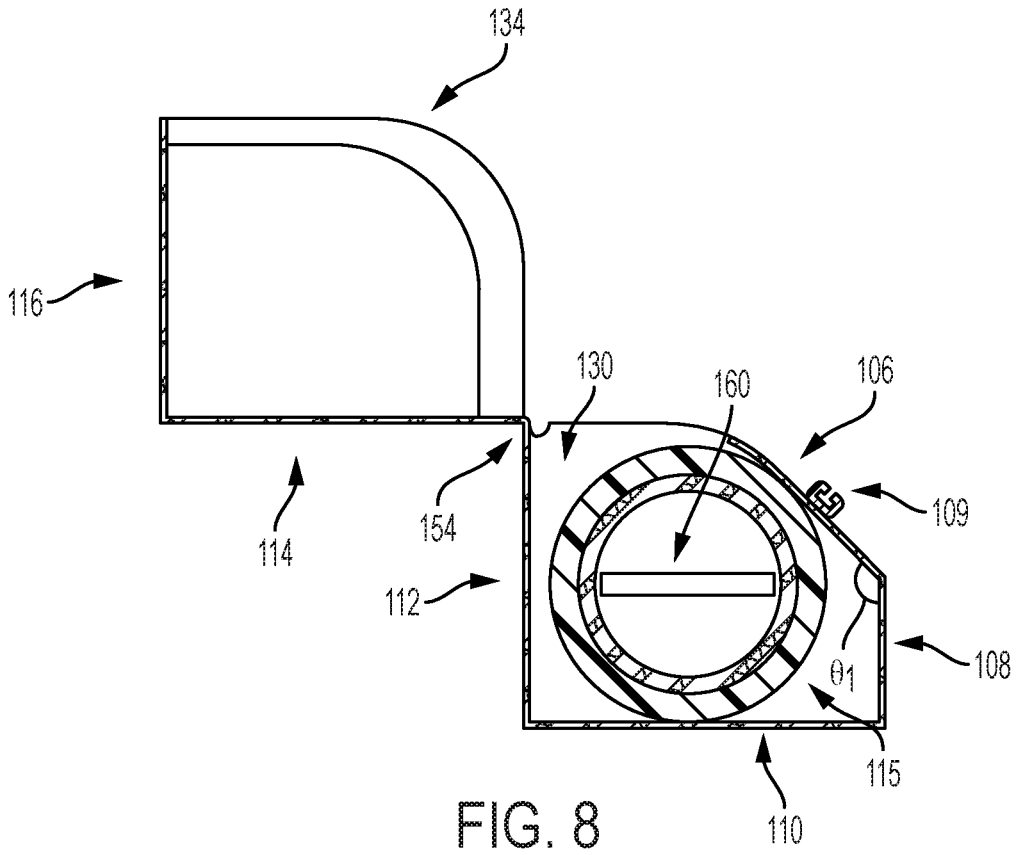
FIG. 8 is a cross-sectional side view of the container of FIG. 1 taken along line 8-8 of FIG. 2.

The front base panel 108 can extend to a front angle panel 106 extending upwardly and inwardly to a front angle free end 146. The front angle panel 106 can extend upwardly and inwardly at an angle $\theta_1$ formed between the front angle panel 106 and the front base panel 108, as shown in FIG. 8. For example, the angle $\theta_1$ can be within a range of 10° to 90°, and as embodied herein can be about 45°. The front angle free end 146 can include cut outs 117 on one or both opposing ends of the base portion 102. Alternatively, the front angle panel can be shortened, such as to the cut outs 117 as shown in FIG. 1 to an alternative front angle edge 188. Additionally or alternatively, the front angle panel 106 can include an intermediate portion disposed between the cutter 107 and the free end 158. The intermediate portion can include opposing ends, wherein each opposing end is joined to opposing sides of the base portion.

As embodied herein, the base portion can further include a back panel 112 extending upwardly from the bottom panel 110 and defining a back of the compartment 103. The back panel 110 can extend to a back panel upper edge 154.

Figure 3:
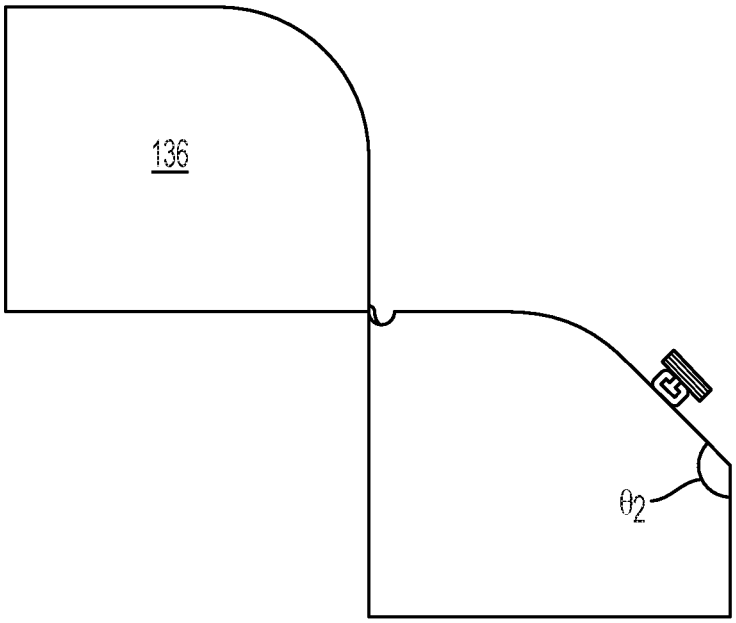
FIG. 3 is a left side view of the container of FIG. 1.
Figure 4:
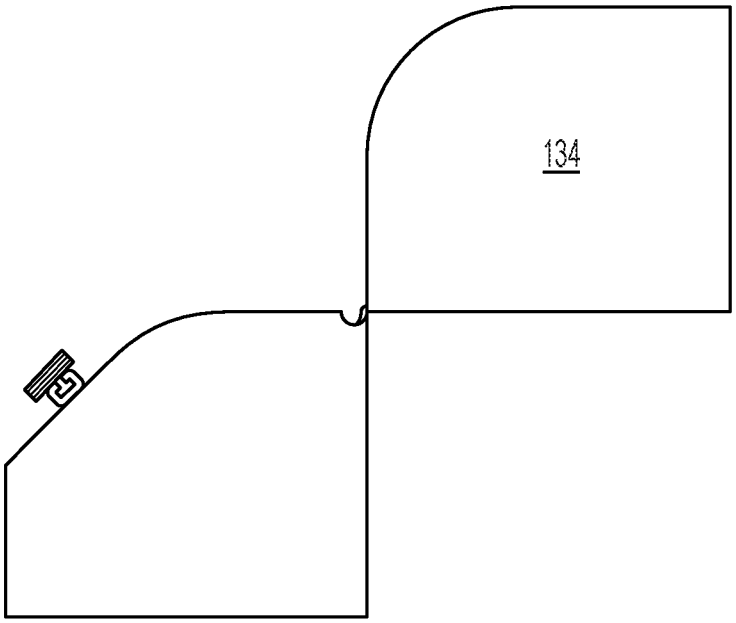
FIG. 4 is a right side view of the container of FIG. 1.
Figure 5:
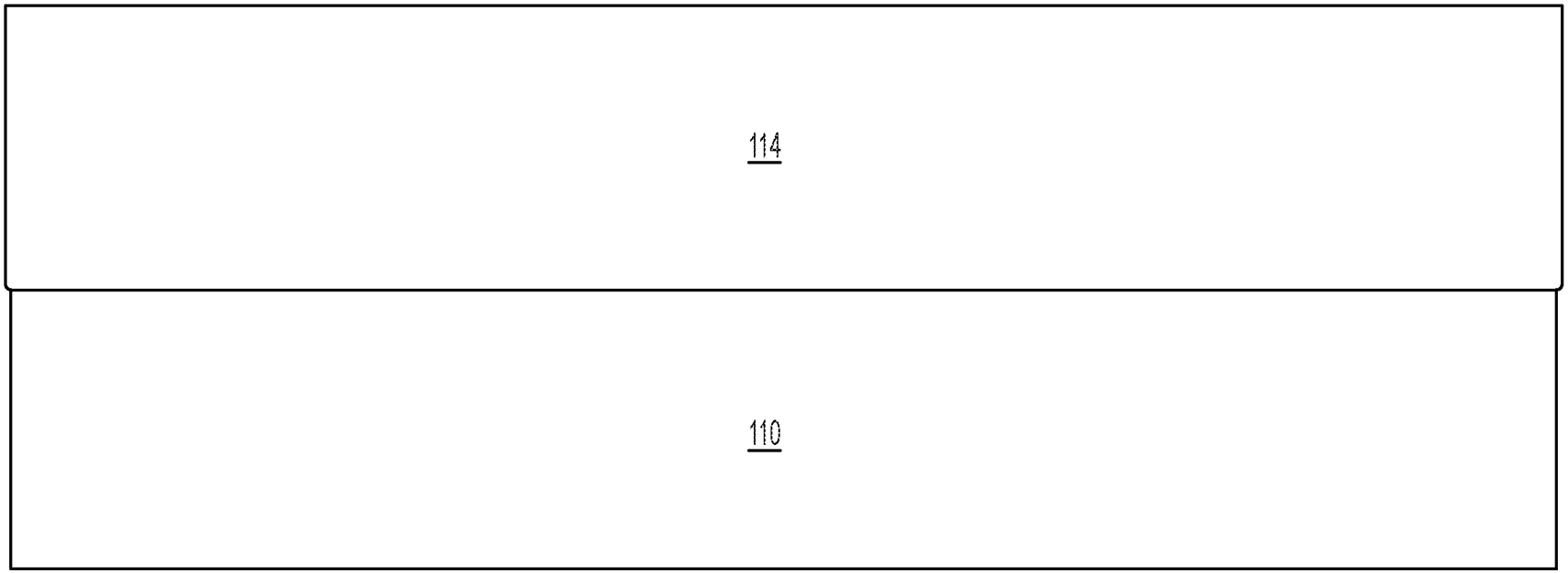
FIG. 5 is a back view of the container of FIG. 1.

The base portion 102 can include first and second back side tabs 130, 132 extending from the base panel 112 to define opposing sides of the compartment 103. The first and second back side tabs 130, 132 can each extend from the base panel 112 to a front edge along the front of the container. The first and second back side tabs 130, 132 each includes a chamfered corner. The chamfered corners are each configured to engage and support the front angle panel 106 at the desired angle. That is, the bottom surface of the opposing ends of the front angle panel 106 can be supported by the chamfered corners. Accordingly, an angle $\theta_2$, as shown in FIG. 3, of the chamfered corners on the back side tabs 130, 132 can define the angle $\theta_1$, as shown in FIG. 8, between the front angle panel 106 and the front base panel 108. The angle $\theta_2$ of the chamfered corners can be defined relative to the front edge of the back side tab. The angle $\theta_2$ can be within a range of 10° and 90°, and as embodied herein can be about 45°. Opposing sides of the container can be defined by additional or alternative end panels with chamfered corners, such as extending from the bottom as described further below.

With reference to FIGS. 1-8, and as embodied herein for illustration and not limitation, the lid portion 104 of the container 100 includes a top panel 114 defining a top cover over the compartment 103, when the container is in the closed position. The top panel can be hingedly coupled to the back panel 112 about a back panel upper edge 154. For example, the top panel 114 can extend from the back panel upper edge 154. To form a hinged connection between the back part of the lid portion, the back panel upper edge 154 can include score lines along its length (not shown). Alternative hinge configurations likewise can be used.

The lid portion generally includes a front lid panel 116 extending downwardly from the top panel 114 when the lid is in the closed position. The front lid panel 116 extends from the top panel 114 to a lid free end 158. The front lid panel 116 defines a front of the lid portion when the lid is in the closed position. The front lid panel 116 can have a front lid panel length extending between opposing sides of the lid portion 104.

The lid portion 104 can further include first and second top side panels 134, 136 extending downwardly from the top panel 114 when the lid is in the closed position. The first and second side panels can thus define opposing sides of the lid portion 104. As shown in FIGS. 1, 3, 4, and 8, for purpose of illustration and not limitation, the first and second top side panels can include a curved corner, e.g. a radiused or arcuate portion, extending from the lower end of the top side panels 134, 136, when the container is in the closed position, to the back panel upper edge 154. The opposing sides of the lid portion can be defined by additional or alternative end tabs with radius or curved corners, such as extending from the front base panel, as further described below.

Figure 2:
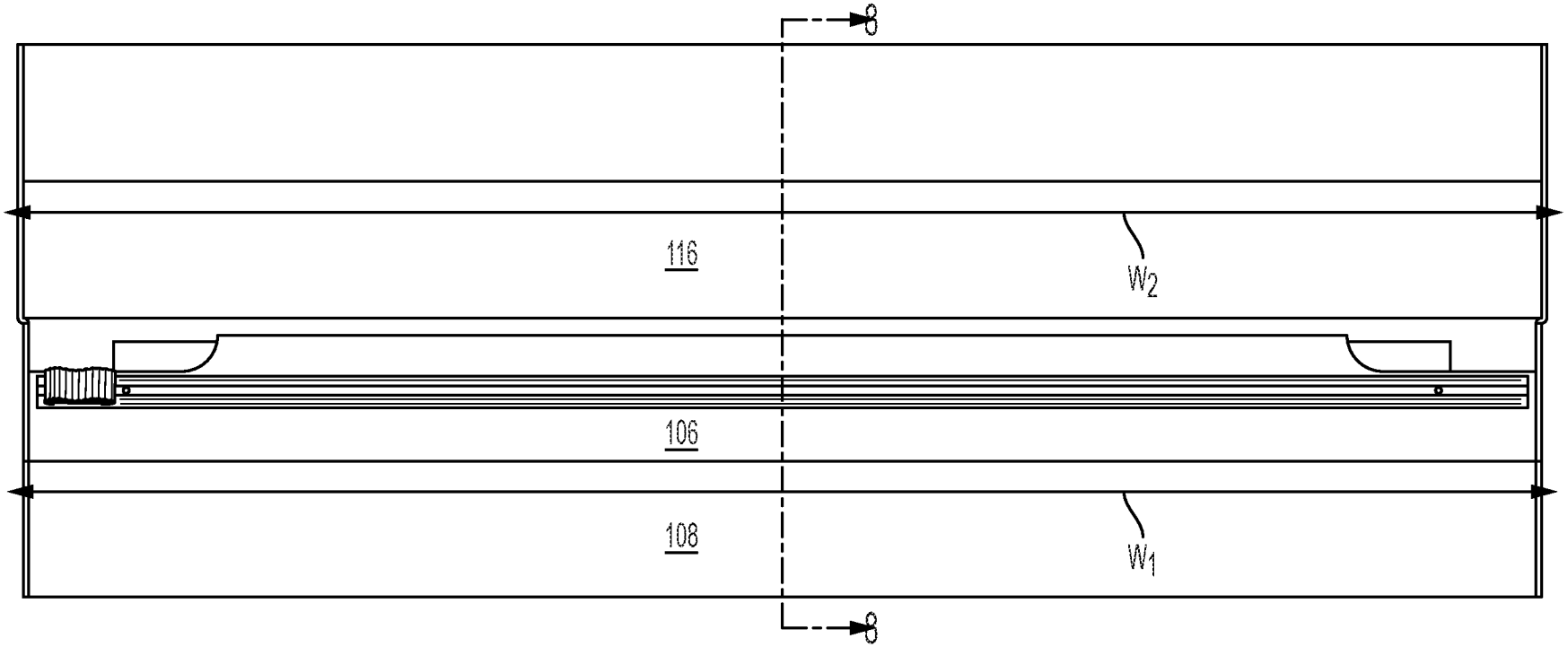
FIG. 2 is a front view of the container of FIG. 1.

The base portion 102 and lid portion 104 can each define a respective width. As shown in FIG. 2, the base portion 102 can have a width $w_1$ defined between the first and second back side tabs 130, 132. The lid portion 104 can a width $w_2$ defined between the first and second top side panels 134, 136. For purpose of illustration and not limitation, and as embodied herein, width $w_2$ can be slightly greater than width $w_1$ to allow the top portion 104 to extend about and proximate to the base portion 102 in the closed position, as described further below.

Figure 6:
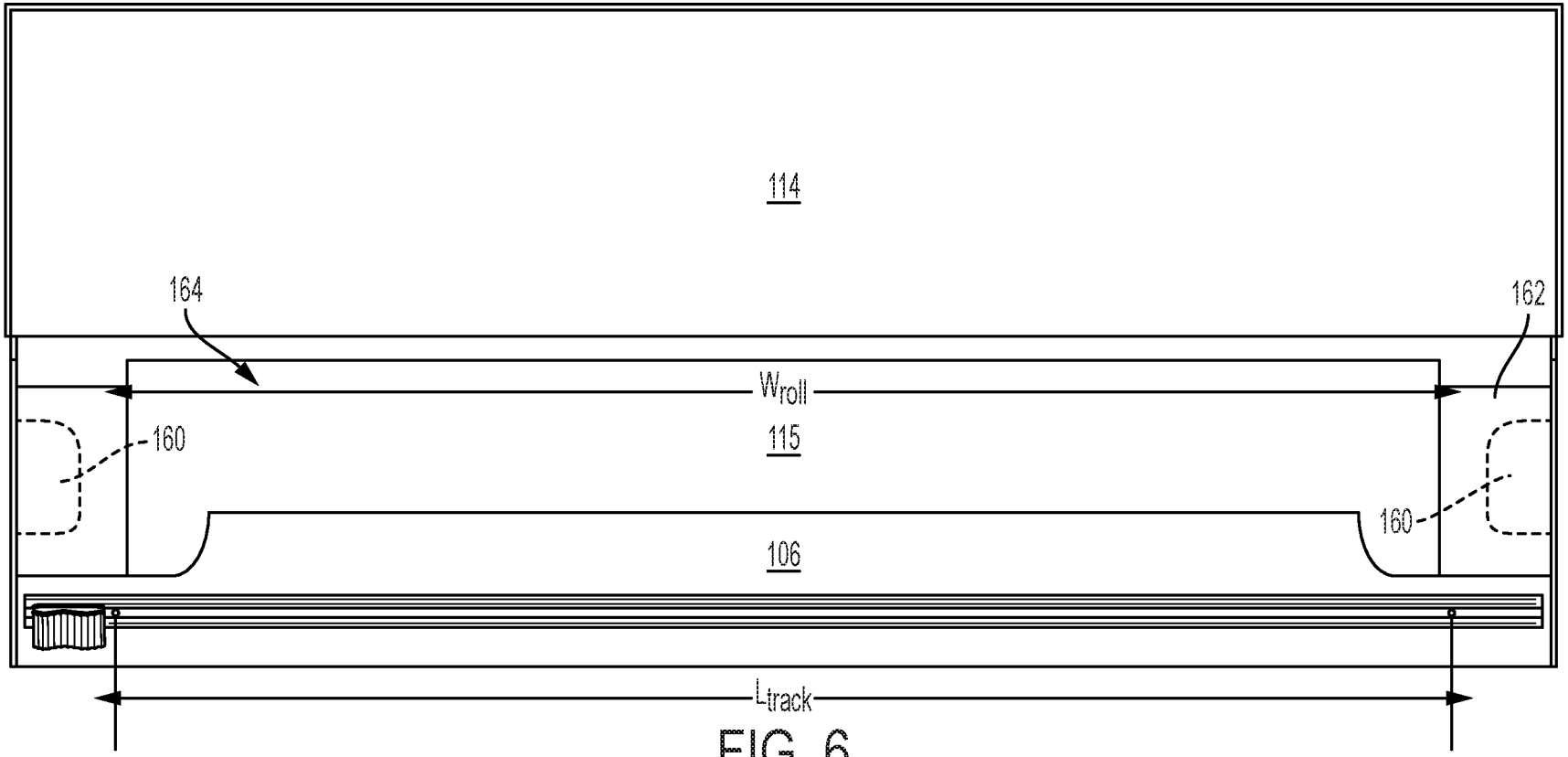
FIG. 6 is a top view of the container of FIG. 1.
Figure 7:
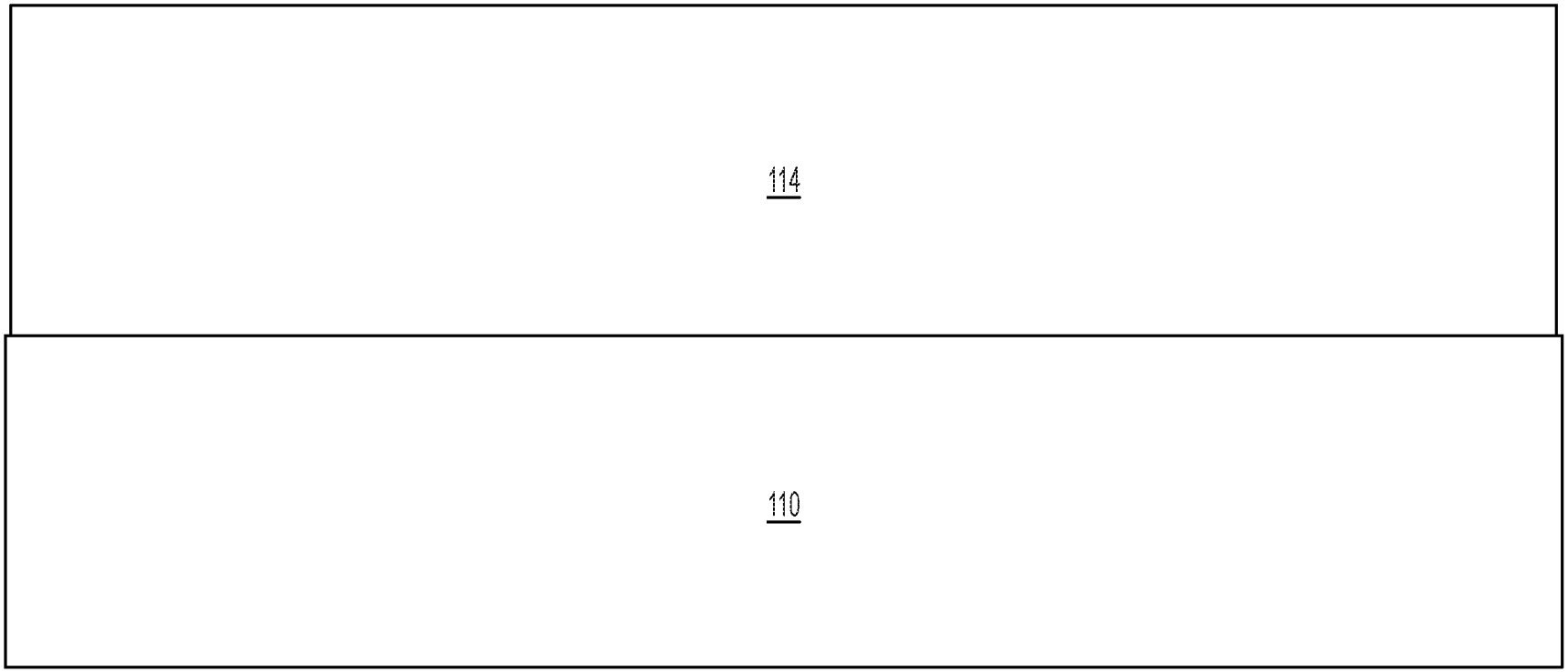
FIG. 7 is a bottom view of the container of FIG. 1.

In accordance with another aspect of the disclosed subject matter, the container 100, as shown in FIGS. 6 and 8, can include end locks 160. The end locks 160 can extend from the opposing sides of the container at least partially into the container compartment 103 from opposing sides of the base portion. When a roll 115 is inside into the container, the end locks 160 can extend the inside of the inner roll 162. As such, the end locks can retain the roll 115 inside the container while allowing for rotational movement of the roll 115 about the end locks. The container can be sized to allow the inner roll 162 to extend to the sides of the container, allowing for the end locks 160 to extend fully into the inner roll 162. As shown in FIG. 8, the end locks 160 can include a long, narrow shape, wherein the end locks are sized to fit within the inside of the inner roll 162. The end locks 160 can include a horizontal orientation, as shown in FIG. 8, to allow the end locks to bend in the vertical direction, thus allowing the roll to be inserted into, and removed from, the container multiple times.

In accordance with another aspect of the disclosed subject matter, a cutter 107 can be disposed on the base portion 102, for example and as embodied herein, proximate the front angle panel 106. The cutter 107 can include a slider 111 and track 109. The track 109 can attach to the front angle panel 106 with an adhesive, or any other securing means. The slider 111 can be configured to slide along the length of the track 109.

A variety of cutter assemblies are known and can be used with the dispensing container of the disclosed subject matter. For the purpose of description and not limitation, suitable cutter assemblies are described in U.S. Pat. Nos. 7,918,151 and 7,921,756, each of which is incorporated by reference herein in its entirety. Additionally or alternatively, as shown in exemplary FIGS. 11-16, for purpose of illustration and not limitation, the cutter 107 can include a channel-shaped track 109 with a slider 111 disposed slidingly thereon. The slider 111 can have an upper slider portion 142, a lower slider portion 146, and an intermediate slider portion 144, disposed between the lower slider portion 146 and the upper slider portion 142.

A blade 140 can be disposed proximate the intermediate slider portion between the upper slider portion 142 and the lower slider portion 146. The blade 140 can be disposed on one or both opposing sides of the intermediate slider portion 144. The blade 140 can extend from the intermediate slider portion 144 outwardly towards a blade edge. The blade edge can define an angle $\theta_3$ within a range of 10° to 90°, and as embodied herein can be about 45°, relative to the lower slider portion.

The upper slider portion 142 can include a top surface contoured to provide a finger engaging surface, such as a concave recess in the body of the upper slide portion 142, which can provide a user with an improved grip to engage the slider. The upper slider portion 142 can include a textured or ridged surface to further improve the grip. The lower slider portion generally includes a body portion or flange dimensioned to fit within the track as further described below.

The track 109 can include bottom, opposing sidewalls extending upwardly from the bottom, and opposing track flanges 154 directed inwardly from the top portion of the opposing sidewalls to define the channel-shaped track. The track flanges 154 each extend from the opposing sidewalls to an inward free end. The track flanges 154 thus form a track gap 152 between the opposing inward free ends. The track flanges 154, opposing sidewalls, and bottom can form a track cavity 158 therein. The intermediate slider portion 144 and blade portion 140 can extend from within the track cavity 158 through the track gap 152 to the upper slider portion 142 disposed above the track.

The lower slider portion 146 is sized to be disposed within the track cavity 158, and to be configured to slide along the inner surfaces of the track bottom, opposing sidewalls, and opposing track flanges 154. As embodied herein, the lower slider portion 146 can form the shape of a rectangular box, having a length dimension along the length of the track, and the width dimension across the track. The length dimension can be greater than the width dimension, thereby improving stability of tortious forces on the slider. For purpose of illustration and not limitation, a lubricious coating can be provided on the lower slider portion and/or inner surface of the track to enhance sliding movement.

Further in accordance with the disclosed subject matter, the track can include detents 113 or the like on opposing ends of the track 109. The detents 113 resist or inhibit movement of the slider 111 along the track 109. As illustrated by way of example, and not limitation, in FIG. 16 the detents 113 can include small protrusions located on the bottom of the track. The protrusions can be sized to resist movement of the slider 111 along the track 109 through effective frictional retention of the slider 111, while still allowing the slider to move over the detents 113 with the application of additional force. As shown in FIG. 6, the detents can be located at opposing ends of the track at a distance $L_{track}$ apart. The distance between the detents $L_{track}$ can be greater than the width of the product on the roll $W_{roll}$ to ensure the slider is out of the way for a new cut. The detents 113 can be configured as spherically-shaped bumps protruding from the bottom of the track 111. Additionally, or alternatively, the detents 113 can be configured having any suitable shapes, including but not limited to squares, rectangles, or triangles. Additionally, or alternatively, the track 109 can include pairs of detents spaced to engage opposing sides of the slider disposed thereon.

The track 111 can further include end stops 148 at opposing track ends 150. The end stops 148 can be disposed on the bottom of the track and can be configured having any suitable shape, for example and as embodied herein, a wedge shape having a flat end facing the inward direction of the track and protruding from the track bottom. The flat end can extend from the bottom of the track to a height h of about one third, or more, toward the opposing top track flanges 154. The flat end thus can be configured to inhibit or prevent the lower slider portion 146 from extending beyond the end stop 148. The end stop 148 can be configured to allow the lower slider portion 146 to move beyond the sloped end of the wedge shape, for example during assembly of the cutter 107. The end stop 148 can be disposed proximate the track ends 150, with the detents 113 spaced a distance from the end stops 148 to accommodate the length of the lower slider portion 146 therebetween. The slider can be disposed between the detents 113 and the end stops 148, for example to secure the slider when not in use.

The track flange 154 can include a flange coating 156 applied to its upper surface. The flange coating can include a material with soft and flexible properties to releasably adhere to a product being cut thereon to inhibit or prevent movement of the product during cutting.

The cutter 107 disclosed herein thus allows for cutting of the roll into sheets with improved accuracy and less effort. In this manner, for purpose of illustration and not limitation, an elastic product, such as plastic film wrap, can be cut without stretching or clumping the product.

As shown in exemplary FIGS. 1-8, for the purpose of illustration and not limitation, the roll 115 of material can be a roll of any suitable film or sheet material, including but not limited to paper, aluminum, tape, plastic, and fabric. The container 100 disclosed herein is particularly suitable and beneficial for use with a film or sheet material to be dispensed into thin sheets, such as plastic film wrap, wax paper, parchment paper, aluminum foil, and the like. As shown in FIG. 6, the roll can include inner roll 162 for holding the film or sheet material of the roll. The inner roll 162 can extend to and mate with the opposing sides of the container to increase stability of the roll during dispensing, and to ensure a maximum amount of the end lock 160 protrudes into the inner roll. The outer roll 164 can include the film or sheet material therein and can have a width $W_{roll}$, as shown in FIG. 6. The front angle panel 106 can further include an adhesive strip 105 disposed thereon to secure the free end of the rolled material while operating the cutter and between uses.

When opening and closing the container 100, for purpose of illustration and not limitation, the lid portion 104 can be hindgedly moveable relative to the base portion 102 between an open position and a closed position about the back panel upper edge 154. When the container 100 is in the closed position, the lid portion can be disposed over the compartment 103 of the base portion. In the closed position, the lid portion 104 protects the roll 115 and the cutter 107 allowing for safe transportation and storage of the container 100. The location of the cutter 107 on the front angle panel 106 makes use of the space within the container compartment between the rounded roll and the rectangular container. As such, the cutter 107 can be fully assembled on the front angle panel 106 in an end useable form, while fully protected by the lid. This allows for delivery of the container 100 to a user fully assembled, thus avoiding the need for any self-assembly. Further, the lid portion 104 allows for efficient stacking of the container 103 for easy storage and/or display on a retail shelf. The lid portion 104 can be secured in the closed position, such as by a frangible sticker 119, as described in additional detail below.

To move the lid portion 104 from the closed position to the open position, a user can engage and rotate the lid portion 104 about the back panel upper edge 154. The lid portion 104 can rotate 270° about the back panel upper edge 154, with exemplary use between 90° and 180° from the closed position, to allow for full access to the roll 115 and cutter 107, and easy operation of the container 100. After use, to move the lid portion 104 from the open position to the closed portion, a user can engage and rotate the lid portion 104 about the back panel upper edge 154 over the base portion compartment 103, and back into the closed position.

Figure 9:
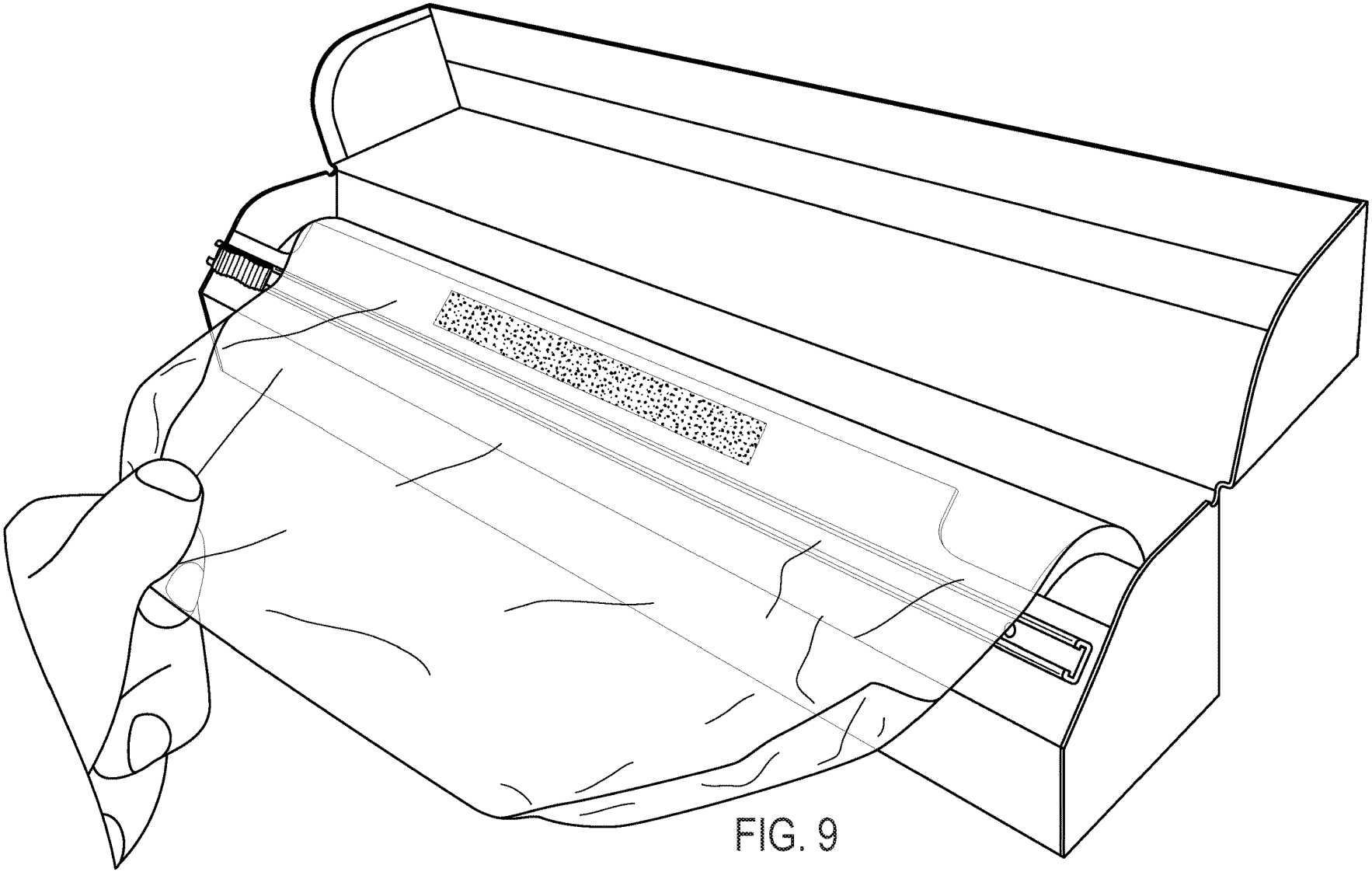
FIG. 9 is a front, right perspective view of the container of FIG. 1, shown with product being dispensed.
Figure 10:
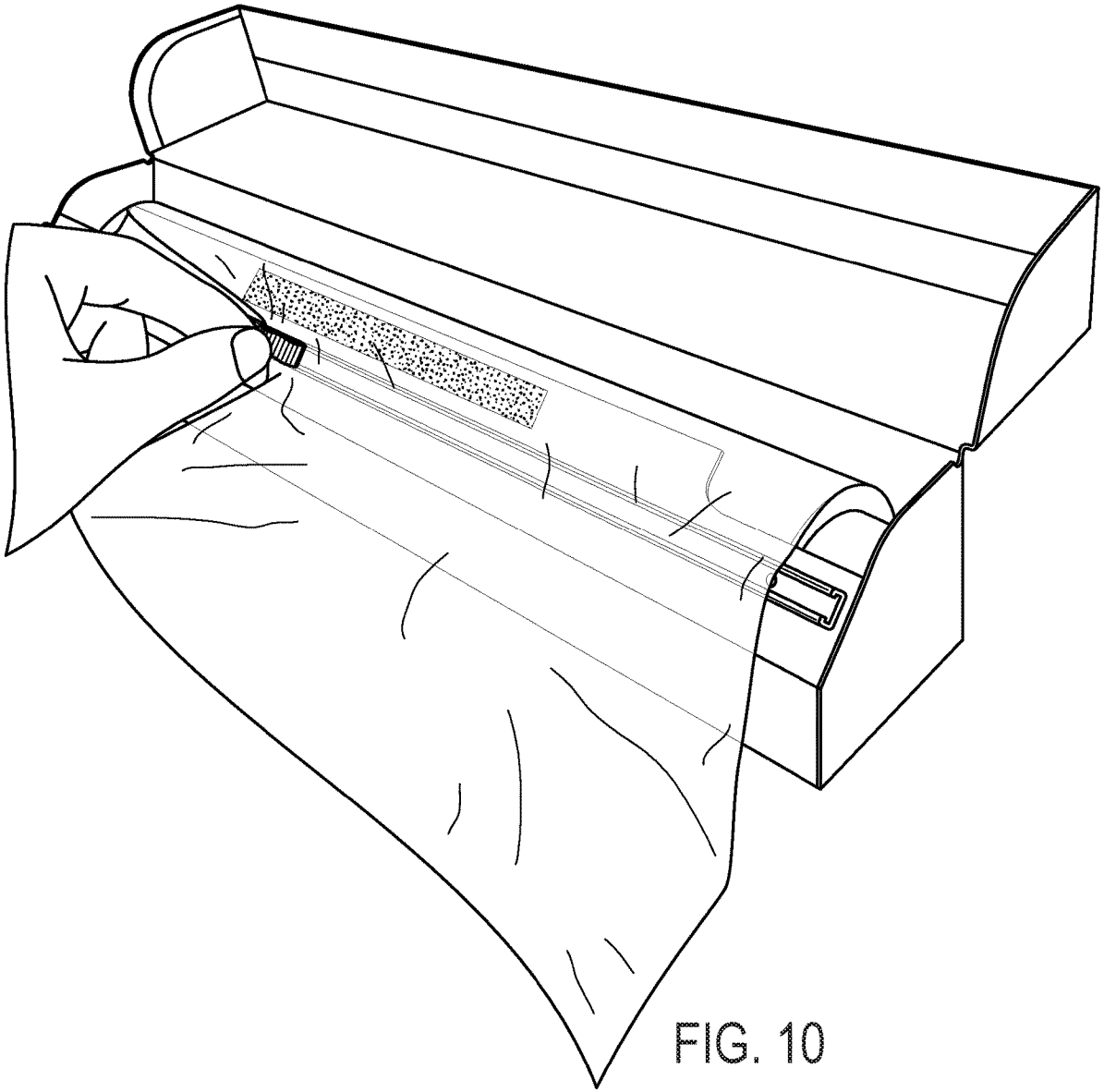
FIG. 10 is a front, right perspective view of the container of FIG. 1, shown with product being cut.
Figure 11:
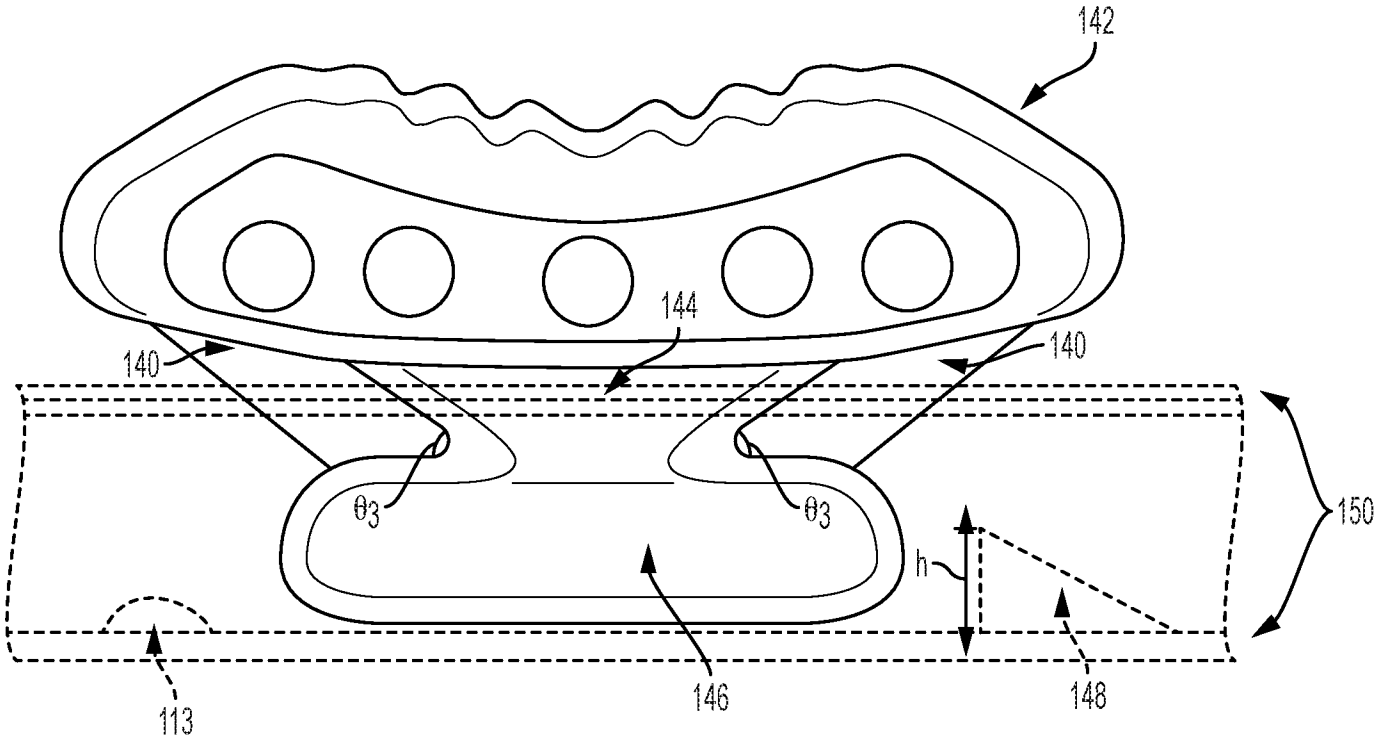
FIG. 11 is a front view of a slider within a track.
Figure 12:
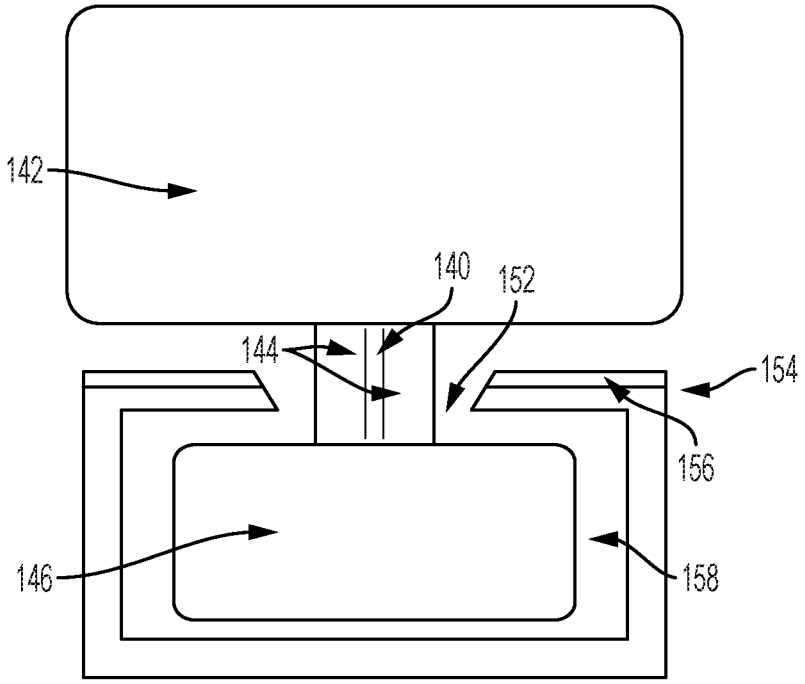
FIG. 12 is a side view of the slider and track of FIG. 11.
Figure 13:
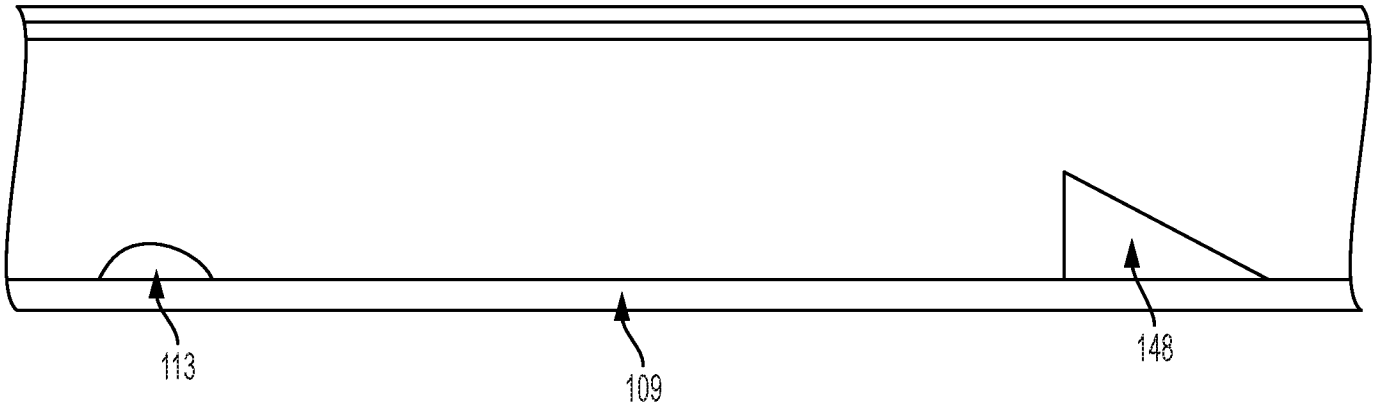
FIG. 13 is a front view of the track of FIG. 11, showing a detent and an end stop on the surface of the track.
Figure 14:
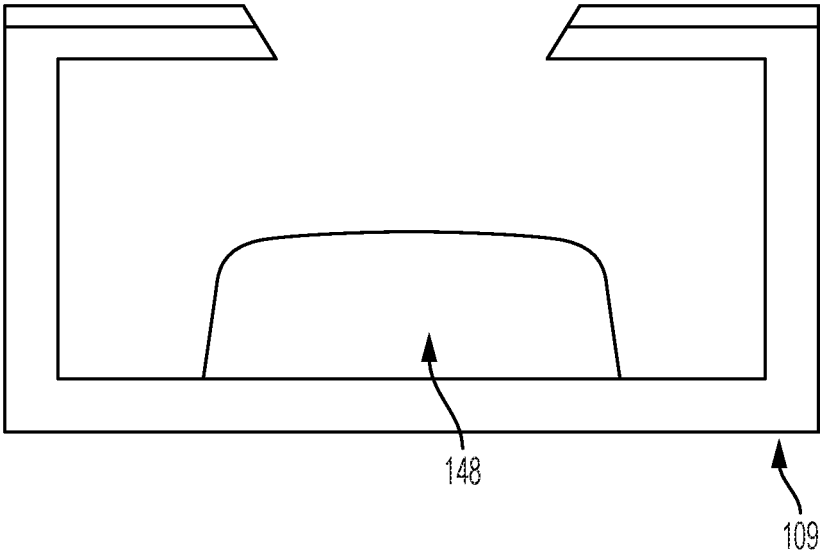
FIG. 14 is a side view of the track of FIG. 11, showing an end stop on the surface of the track.
Figure 15:
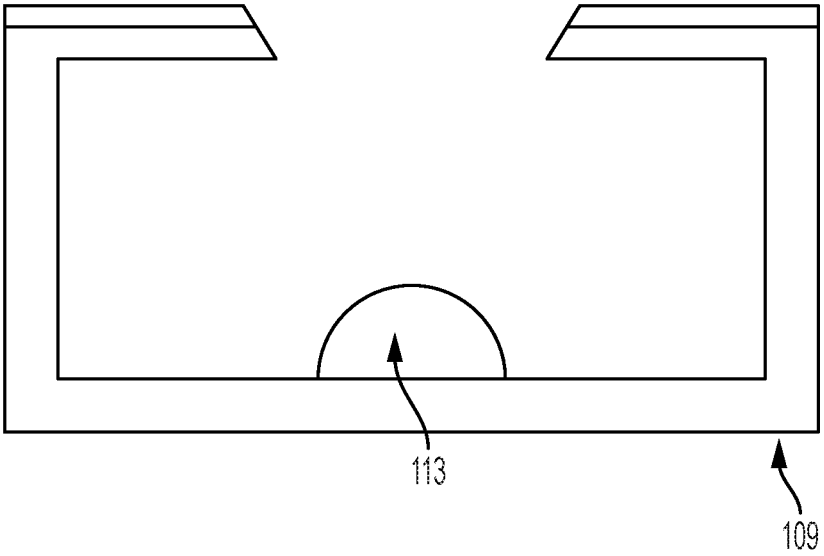
FIG. 15 is a side of the track of FIG. 11, showing a detent on the surface of the track.
Figure 16:
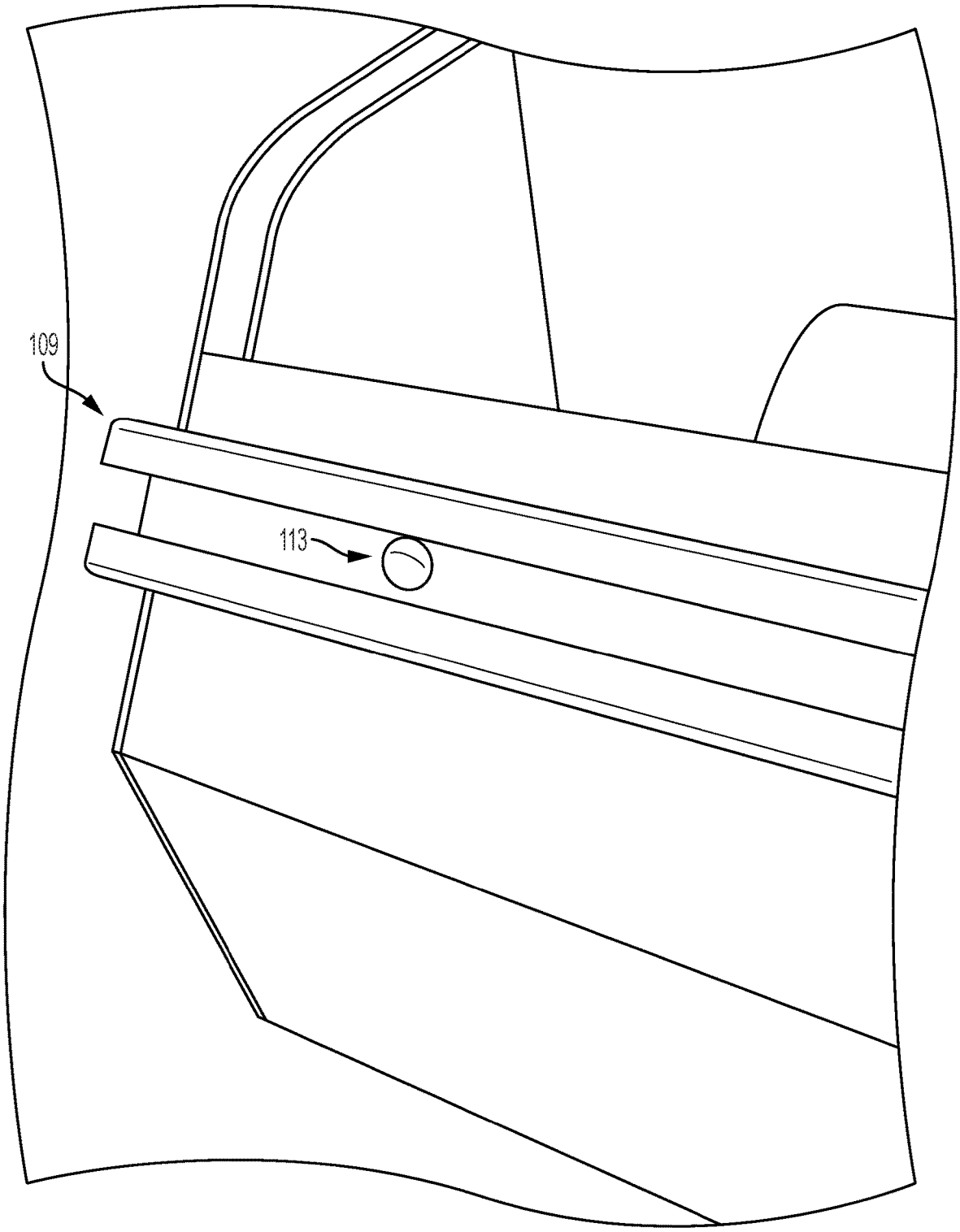
FIG. 16 is an enlarged front, right perspective view of an end of a track disposed on the container of FIG. 1, showing a detent on the surface of a track.

In operation of dispensing film or sheet material from the container 100, as shown in exemplary FIGS. 9 and 10, when the container 100 is in the open position, a user can engage the film or sheet material, such as plastic film wrap, contained on the roll 115, and dispense a desired amount up and over the front angle free end 146 and cutter 107. During dispensing of product from the roll 115, the front angle panel 106 can keep the roll 115 secured within the container 100. The dispensing of the roll 115 creates a substantially upward and angled force of the roll 115 that is counteracted by the front angle panel 106 located substantially above the roll 115, which can engage the roll during dispensing and retain the roll with the compartment. The front angle panel can include an intermediate portion that is joined at either end to the opposing sides of the base portion, thus enhancing the structural strength of the front angle panel 106. The intermediate portion can be between the cutter 107 and the free end 158. The angle and position of the front angle panel 106 allows a user to access the roll 115 and engage a free end of the wrap to initiate the dispensing process. The cut outs 117 further increase the accessibility of the roll, for example, in between cuts. Additionally, the angle, position, and flexibility of the front angle panel 106 allows the entire roll 115 to be completely removed or inserted from the container 103 by a user, if so desired. Additionally, the end locks 160 can also counteract the substantially upward and angled force of the roll 115 by engaging the inside surface of the inner roll 162. Alternatively, the front angle panel can be shortened, such as to the cut outs 117 as shown in FIG. 1 to an alternative front angle edge 188, to allow increased access to the roll. With a shortened front angle panel 106, the end locks 160 can counteract the substantially angled and upward force of the roll 115.

As shown in exemplary FIG. 10, to remove the desired amount of product, the user can lay the product along the front angle panel 106 and cutter track 109 and slide the slider piece 111 along the length of the track 109 to engage and cut through the product. Once a desired product sheet is removed from the roll 115, the sheet can be used for any desired purpose, such as covering an item. As the product sheet is being cut, the user can slide the slider 111 past the detents 113 to secure the slider 111 on the side of the track 109 for a future use (as further explained below). Optionally, the user can secure the remaining product between the cutter 107 and the roll 115 onto the adhesive strip 105 for a future use. The adhesive strip 105 can be configured retain the product within compartment 103 during storage and transportation of the container 100. Additionally or alternatively, adhesive can be disposed directly onto the slider track and can be similarly configured to retain the product within compartment 103. The use of the adhesive, whether disposed on a panel or on the track, allows the user to remove the end of the product without needing to re-engage the roll 115.

Figure 17:
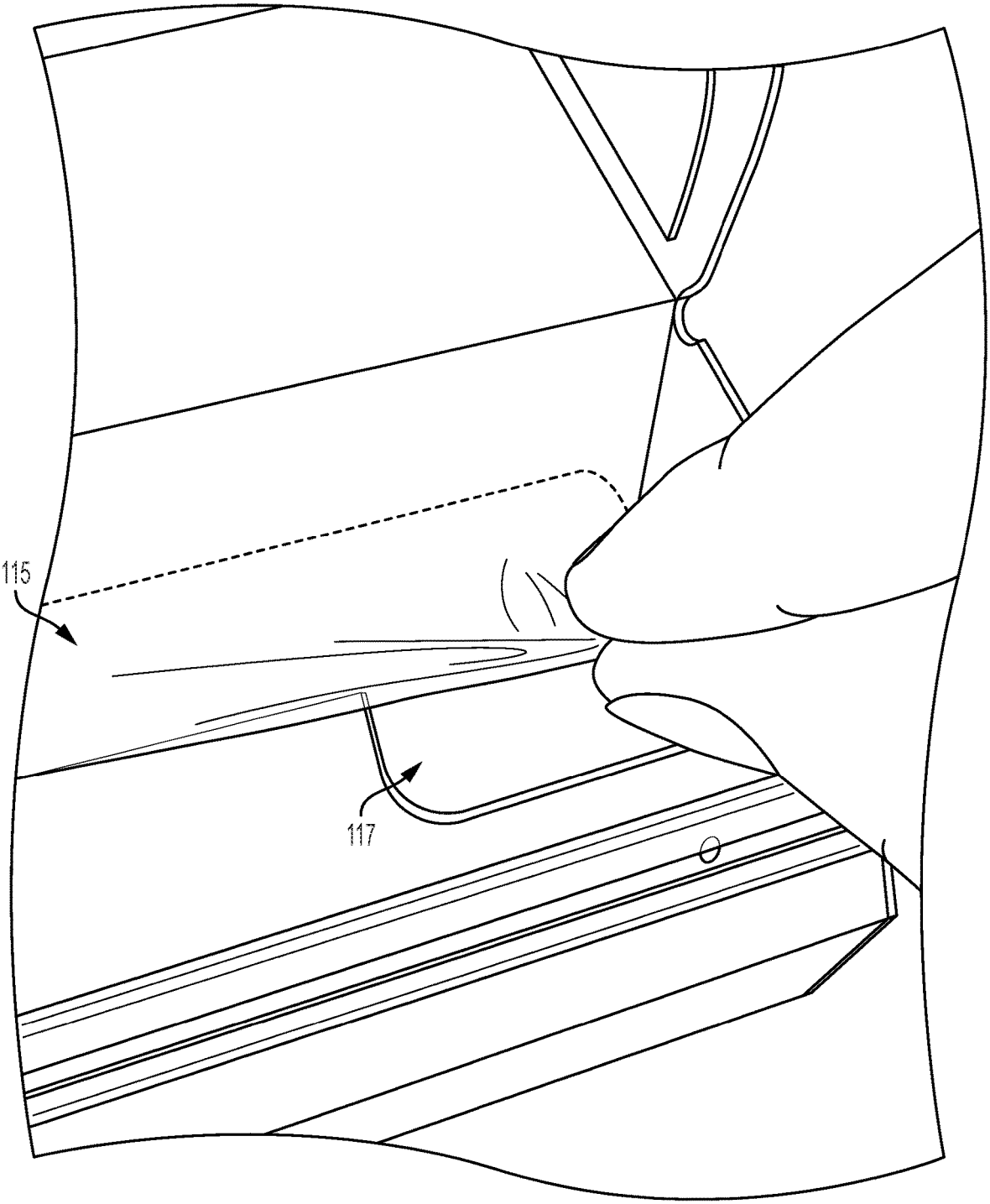
FIG. 17 is a top left perspective view of a cut out in the container of FIG. 1, showing a user engaging the product.

As shown in exemplary FIG. 17 for illustration and not for the purpose of limitation, the cut outs 117 on the front angle panel can facilitate easy access to the roll, such as access to the end of the roll 115 of product as embodied herein. The cut outs 117 can be located on either or both ends of the front angle panel 106. Alternatively, there can be a single cut out located along the length of the front angle panel 106. As shown in exemplary FIGS. 1 and 17, the cut outs 117 can be substantially rectangular in shape. Alternatively, the cut outs can have a rounded shape, square shape, or any other shape. The inner corner of the cut outs 117 can be rounded, as shown in FIG. 17, or can include a sharp angle. The outer corner of the cut out can be a sharp angle, as shown in FIG. 17, or can include a rounded edge.

Figure 18:
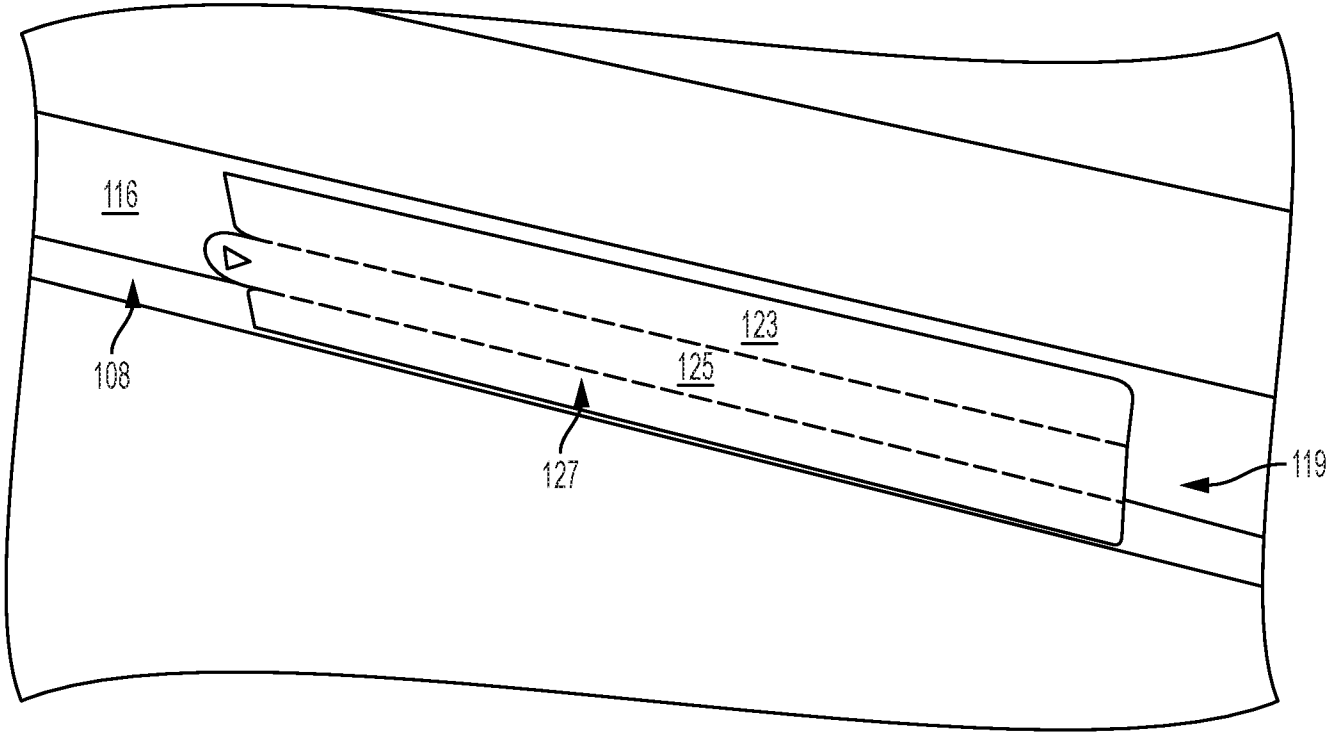
FIG. 18 is a right perspective view of a frangible sticker on the container of FIG. 1.

As shown in exemplary FIG. 18, the container can additionally include a frangible sticker 119 disposed between the front lid panel 116 and front base panel 108. The frangible sticker 119 can be configured to keep the container 100 secure in the closed position by operatively connecting the front base panel 108 to the front lid panel 116. The frangible sticker can be formed integrally with and as part of the lid portion, or as a separate piece as embodied herein for illustration and not for limitation. That is, the frangible sticker 119 can include an upper panel 123, a strip panel 125, and a lower panel 127. For purposes of illustration and not limitation, the frangible sticker 119 can include two rows of perforated strips along its length and a tab with an arrow located thereon. Additionally or alternatively, the frangible sticker 119 can include two tabs, one located on each end of the frangible sticker. The perforated strips can be configured to separate the strip panel 125 from the upper panel 123 and lower panel 127. The upper panel 123 can be secured to the front lid panel with adhesive, or any other securing means. Similarly, the bottom panel 127 can be secured to the front base panel 108 with adhesive, or any other securing means. In operation, a user can engage the arrowed tab and pull the strip portion away from the upper portion and lower portion at the perforated strips. Once the strip is removed, the frangible sticker no longer operatively connects the front angle panel to the front lid panel and the lid portion is free to move to the open position. Additionally or alternatively, the strip panel 125 can include a reinforcing material. For example, the reinforcing material can substantially cover the area of the strip panel 125. The reinforcing material can include a sturdier material than the frangible sticker such that the reinforcing material ensures the strip panel 125 remains intact during operation. For purpose of illustration and not limitation, the frangible sticker can be manufactured from a thin sheet of polyethylene terephthalate and the reinforcing material can be manufactured from paper with a weight of at least around 105 grams per square inch.

Alternatively, the front lid panel 116 can be extended beyond the lid free end 158 to form the frangible sticker. The front lid panel 116 can extend to the front base panel 108, when the container is in the closed position. The front lid panel can include a perforated strip along its length, and a tab on the strip. The front lid panel can be adhered to the front angle panel with adhesive to secure the container in the closed position. To open the container 100, a user can engage the tab and disengage the strip portion at the perforations.

According to another aspect of the disclosed subject matter, a container formed from a blank is provided. The blank of the disclosed subject matter includes a bottom portion having a bottom panel including opposing first and second bottom end fold lines. A front base panel extends from the first bottom end fold line to a front fold line. A front angle panel extends from the front fold line to a front angle free end. A back panel extends from the second bottom end fold line to a base-lid hinge line, the back panel having opposing first and second back side fold lines. First and second back side tabs extend from the first and second back side fold lines, respectively, to a first and second back side edge, each back side tab having a chamfered corner.

Additionally, and further to the above, the blank of the disclosed subject matter includes a lid portion having a top panel extending from the base-lid hinge line to a top front fold line, the top panel having opposing first and second top side fold lines. A front lid panel extends from the top front fold line to a lid free end, and first and second top side panels extend from the first and second top side fold lines, respectively, to a first and second top side edge.

Figure 19:
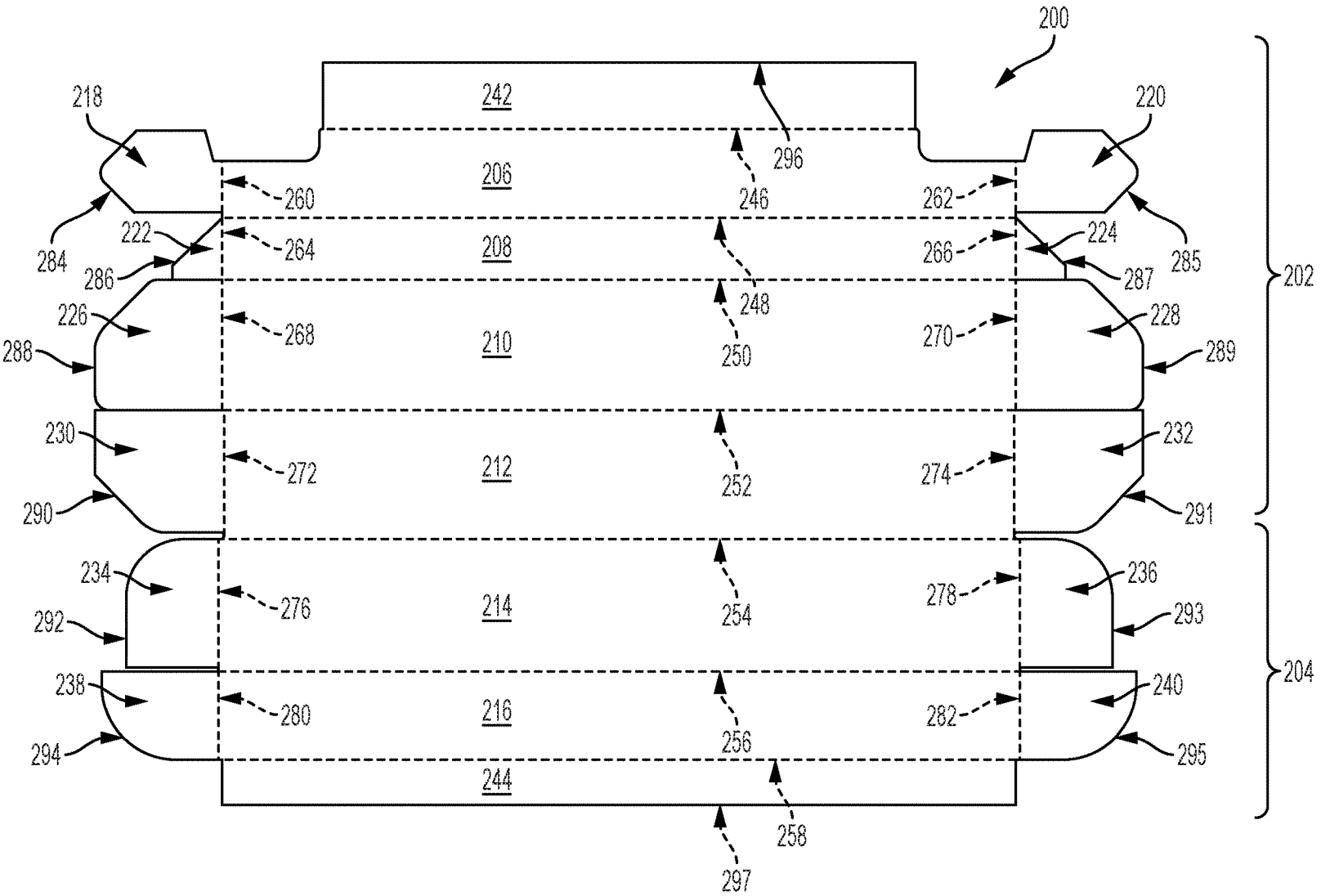
FIG. 19 is a plan view of an exemplary embodiment of a blank for forming the container of FIG. 1 in accordance with the disclosed subject matter.

Referring now to the blank 200 of FIG. 19, the container 100 can be formed from a base portion 202 having a bottom panel 210 and a lid portion 204 having a top panel 214. To form the base portion 202 of the container 100 from blank 200, the bottom panel can include opposing first and second bottom end fold lines 250, 252 and opposing first and second bottom side fold lines 268, 270.

A front base panel 208 can be coextensive with the bottom panel 210 along the first bottom end fold line 250. The front base panel 208 can extend from the first bottom end fold line 250 to a front fold line 248. The front fold line 246 can include score lines along its length. The front base panel can include opposing first and second front side fold lines 264, 266.

A front angle panel 206 can be coextensive with the bottom front base panel along the front fold line 248. The front angle panel 206 can extend from the front fold line 248 to a front angle free end 246. The front angle panel 206 can be configured to form an angle of 10° to 90°, preferably about 45°, relative to the front base panel 208. The front angle panel 208 can include cut out corners along opposite ends of the front angle free end 246. The front angle panel can further include opposing first and second front angle fold lines 260, 262.

A back panel 212 can be coextensive with the bottom panel 210 along the second bottom end fold line 252. The back panel 212 can extend from the second bottom end fold line 252 to a base-lid hinge line 254. Opposing first and second back side tabs 230, 232 can be coextensive with the back panel 212 along corresponding first and second back side fold lines 272, 274. Each of the first and second back side tabs 230, 232 can extend from the first and second back side fold lines 272, 274 to corresponding first and second back side edges 290, 291. The back side tabs 230, 232 can include a chamfered corner on the back side edge at each corner opposite the corresponding bottom side panels 226, 228. The chamfered corner can be configured to engage and support the front angle panel 206. The chamfered corner can have an angle within a range of 10° to 90°, and as embodied herein about 45°, relative to the side of the back side edges 290, 291. The base-lid hinge line 254 can include score lines along its length.

To form the lid portion 204 of the container 100 from the blank 200, the lid portion can include the top panel 214. The top panel 214 can be coextensive with the back panel 212 along the base-lid hinge line 254. The top panel 214 can extend from the base-lid hinge line 254 to a top front fold line 256.

Opposing first and second top side panels 292, 293 can be coextensive with the top panel 214 along corresponding first and second top side fold lines 276, 278. Each of the first and second top side panels 234, 236 can extend from the first and second top side fold lines 276, 278 to corresponding first and second top side edges 292, 293. The top side panels can include a rounded corner along the top side edges 292, 293.

A front lid panel 216 can be coextensive with the top panel 214 along the top front fold line 256. The front lid panel 216 can extend from the top front fold line 256 to a lid free end 258. The front lid panel can include opposing first and second front lid side fold lines (280, 282).

Still referring to the blank 200 of FIG. 19, the blank can additionally, or alternatively, include the following tabs and panels. A front lid end tab 244 can be coextensive with the front lid panel 216 along the lid free end 258. The front lid end tab 244 can extend from the lid free end 258 to a front lid end tab outer edge 297. The front lid end tab 244 can be configured to fold onto the front lid panel 216 about the lid free end 258, forming an edge at the lid free end 258. When formed into a container, the blank front lid end tab 244 can be configured to be secured to the front lid panel 216 with adhesive, or any other securing means.

Additionally or alternatively, the front lid end tab can be configured to form a frangible sticker, as shown for example in FIG. 18. The front lid end tab can extend from the lid free end and include perforations along its length, and a tab with an arrow. The front lid end tab can be configured to adhere to the front angle panel with adhesive.

Referring again to FIG. 19, a front angle end tab 242 can be coextensive with the front angle panel 206 along the front angle free end 246. The front angle end tab 242 can extend from the front angle free end 246 to a front angle end tab outer edge 296. The front angle end tab 242 can be configured to fold onto the front angle panel 206 about the front angle free end 246, forming an edge at the front angle free end 246. The front angle end tab 242 can be secured to the front angle panel 206 with adhesive, or any other securing means. The front angle end tab 242 can extend from the front angle free end 246 up to, but not including the cut out corners.

Opposing first and second front angle side tabs 218, 220 can be coextensive with the front angle panel 206 along corresponding first and second front angle side fold lines 260, 262. Each of the first and second front angle side tabs 218, 220 can extend from the first and second front angle side fold lines 260, 262 to corresponding first and second front angle side edges 284, 285. The cut out corners on the front angle panel can extend beyond the front angle side fold line and partially into the front angle side tabs. The side edges can include two chamfered corners forming a rounded tip at the edge portion between the two chamfered corners.

Opposing first and second front side tabs 222, 224 can be coextensive with the front base panel 208 along corresponding first and second front side fold lines 264, 266. The front side tabs can extend from the first and second front side fold lines 264, 266 to corresponding first and second front side edges 286, 287. The front side edges 286, 287 can include a chamfered corner. The chamfered corner can extend from the front side edges 286, 287 to the corresponding intersection of the front fold line 248 with the front side fold line 264, 266.

Opposing first and second bottom side panels 226, 228 can be coextensive with the bottom panel 210 along corresponding first and second bottom side fold lines 268, 270. Each of the first and second bottom side panels 226, 228 can extend from the first and second bottom side fold lines 268, 270 to a corresponding first and second bottom side edge 288, 289. The bottom side edges 288, 289 can include a chamfered corner.

Opposing first and second front lid side tabs 238, 240 can be coextensive with the front lid panel 216 along corresponding first and second front lid side fold lines 280, 282. Each of the first and second front lid side tabs 238, 240 can extend from the first and second front lid side fold lines 280, 282 to corresponding first and second front lid side edges 294, 295. The front lid side edges 294, 295 can include a curved corner extending from an outermost edge of the front lid side edge to the corresponding intersection of the front lid side fold line 280, 282 with the lid free end 258.

The side tabs and portions of the blank 200 can be configured to be arranged to in a manner to structurally support the container 100. Regarding the base portion of the container, when the blank 200 is formed into the container 100 the front angle side tabs 218, 220 and the front side tabs 222, 224 can be arranged between the back side tabs 230, 232 on their inner surface, and the bottom side panels 226, 22 on their outer surface. Accordingly, the container can have sides of the base portion 202 defined by the front angle side tabs 218, 220, front side tabs 222, 224, bottom side panels 226, 228, and back side tabs 230, 232. These tabs and panels can be adhered to one another using adhesive, or any other securing means.

The chamfered corner of the back side tabs 230, 232 can be configured to engage and support the front angle panel 206 along the front angle side fold line 262. Accordingly, when the container is formed, the front angle panel 206 can define an angle relative to the front base panel 208 that is substantially equal to the angle of the chamfered corners of the back side tabs 230, 232. Additionally, the angle of the chamfered corner on the bottom side panels 226, 228 can be substantially similar to the angle of the chamfered corner of the back side tabs 230, 232 to allow the back side panels to form a substantially flush outside panel on the side of the base portion 202. The angle of the chamfered corners, and corresponding front angle panel can be in the range of 10° to 90°, and as embodied herein, the angle can be about 45°.

Regarding the lid portion 104 of the container, when the blank is formed into the container 100, the top side panels 234, 236 can be adhered to the outside surface of the front lid side tab 238, 240. Accordingly, the container can have sides of the lid portion 204 defined by the top side panels 234, 236 and the front lid side tabs 238, 240. These sides can be adhered to each other using an adhesive, or any other securing means.

Figure 25:
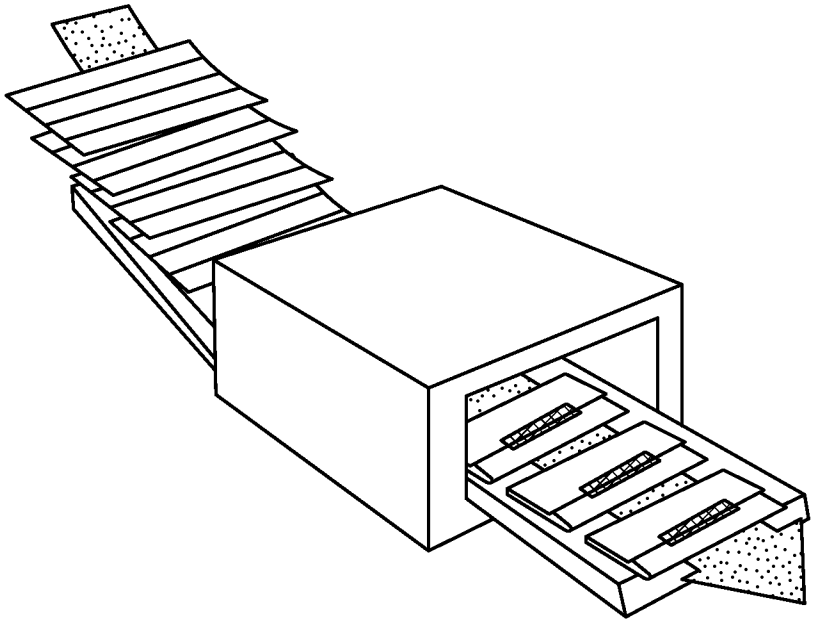
FIG. 25 is a schematic diagram illustrating folding rectangular panels of the blank of FIG. 14 using a machine for forming the container of FIG. 1.

The container 100 can be formed from the blank 200 by any suitable manufacturing means, including manually or by a fully automated process. For purposes of illustration, and not limitation, the container 100 can be manufactured by an assembly process generally as follows. The rectangular panels 206, 208, 210, 212, 214, 216 can be folded, as shown for example in FIGS. 20 and 25, to form a folded blank. Folding the panels can be performed manually by a human or automatically by a machine, as shown in FIG. 25. The folded blank can be held together by a frangible sticker, a piece of tape, temporary adhesive, or any other securing means. A dieline on the blank 200 can be used to for easy manual assembly.

Figure 21:
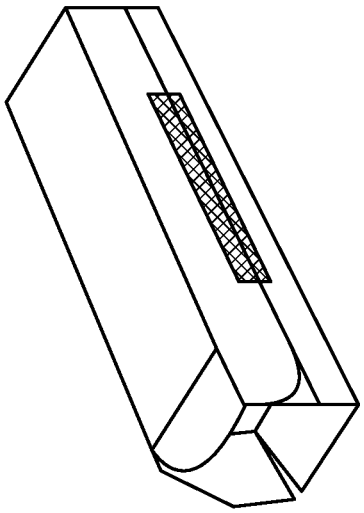
FIG. 21 is a schematic diagram illustrating erecting the folded blank of FIG. 15 for forming the container of FIG. 1.
Figure 23:
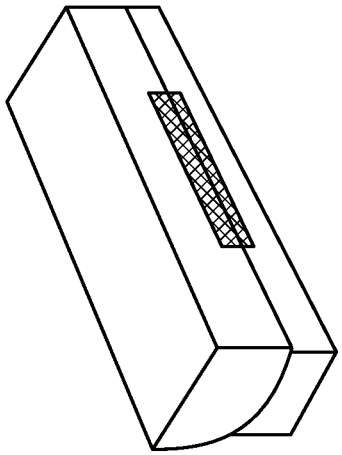
FIG. 23 is a schematic diagram illustrating the container of FIG. 1 assembled in accordance with the disclosed subject matter.
Figure 20:
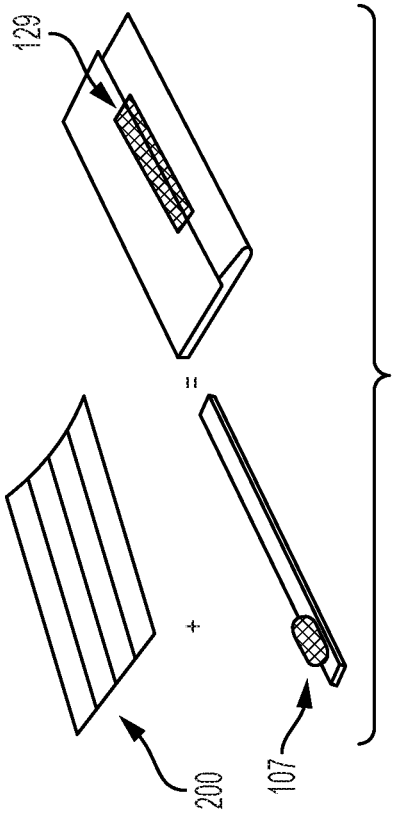
FIG. 20 is a schematic diagram illustrating folding the panels of the blank of FIG. 14 for forming the container of FIG. 1.
Figure 22:
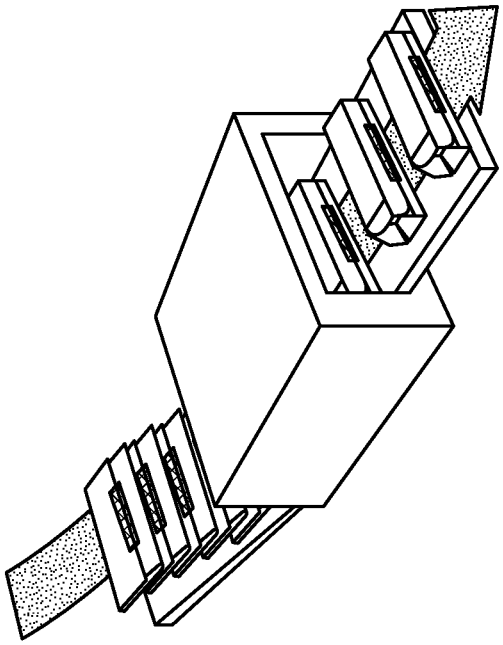
FIG. 22 is a schematic diagram illustrating erecting the folded blank of FIG. 15 using a machine for forming the container of FIG. 1.
Figure 24:
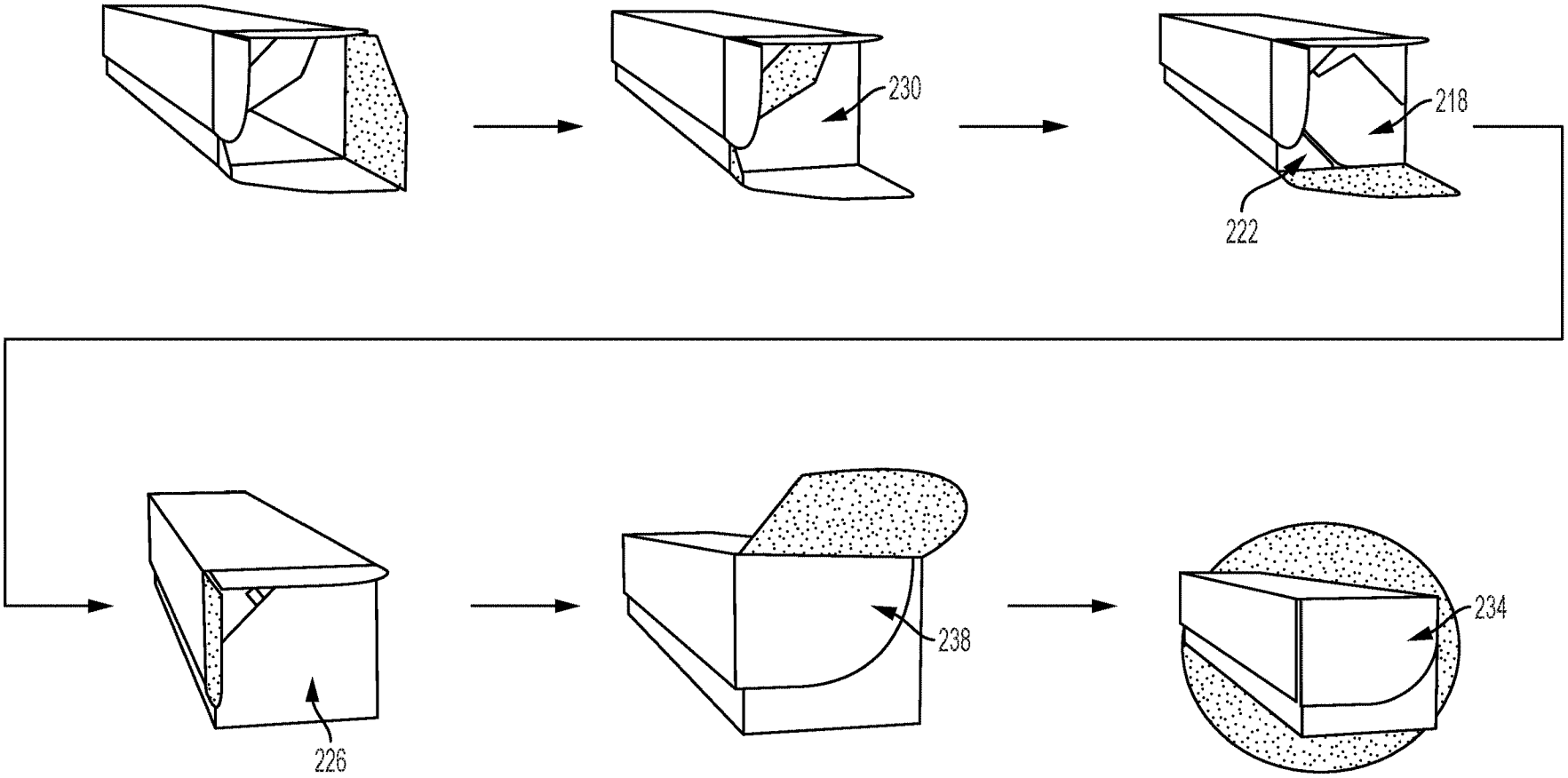
FIG. 24 is a schematic diagram illustrating sequentially folding the side panels of the erected blank of FIG. 21 or 22 for forming the container of FIG. 1.

The folded blank can be erected, as shown in FIG. 21 to form an erected blank. Erecting the blank can be performed manually, or can be performed automatically by a machine, as shown in FIG. 22. The side tabs of the erected blank can be folded inward to form an assembled container. Folding the side tabs can be performed manually, or can be performed automatically by a machine. As shown in FIG. 24, for purpose of illustration and not limitation, sides of the container 100 can be formed by folding the tabs and panels in the following order: the back side tabs 230, 232, followed by the front angle side tabs 218, 220, followed by the front side tabs 222, 224, followed by the bottom side panels 226, 228, followed by the front lid side tabs 238, 240, and finally followed by the front side panels (234, 236). An exemplary embodiment of the formed container 100 is shown in FIG. 25.

Figure 26:
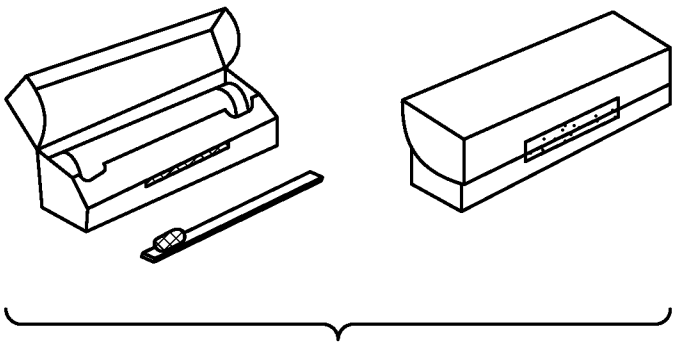
FIG. 26 is a schematic diagram illustrating attaching a cutter for forming the container of FIG. 1.

The cutter 107 can be added at any time during the assembly, for example, before the container is erected, as shown in FIG. 22, or after, as shown in FIG. 26. Similarly, the frangible sticker 119 and adhesive strip 105 can also be added at any time during the assembly. As embodied herein, the container 100 can be erected with the cutter 107 inside the blank 200. The roll 115 can be added before or after the ends of the container 100 are sealed. The cutter 107 and roll 115 can be added manually or by a machine. Indeed, generally all of the steps recited above can be performed manually, by a machine, or by any combination thereof.

Figure 28:
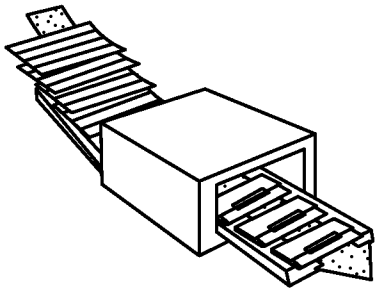
FIG. 28 is a schematic diagram illustrating inserting the angled insert into a hooded box of the container of FIG. 1.
Figure 27:
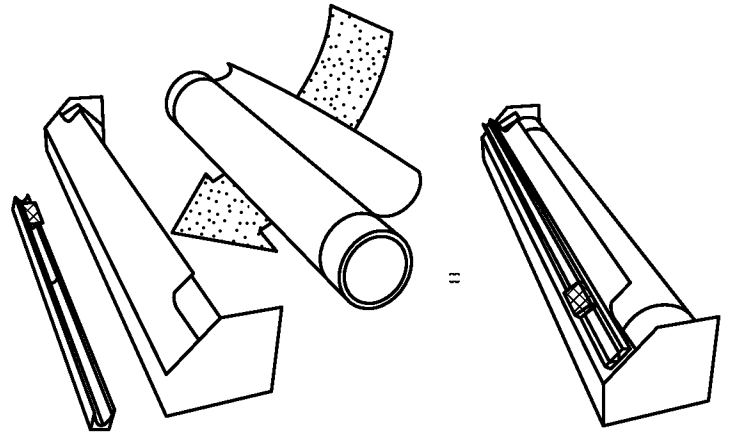
FIG. 27 is a schematic diagram illustrating inserting a roll into an angled insert of the container of FIG. 1 having a multi-piece construction.

Alternatively, as shown in FIGS. 27 and 28, the container can be assembled in two parts and combined. The first part can be an angled insert into which the roll 115 is inserted, as shown for example in FIG. 27. The second part can be configured as a hooded box into which the roll and angled insert are inserted, as shown for example in FIG. 28.

Figure 29:
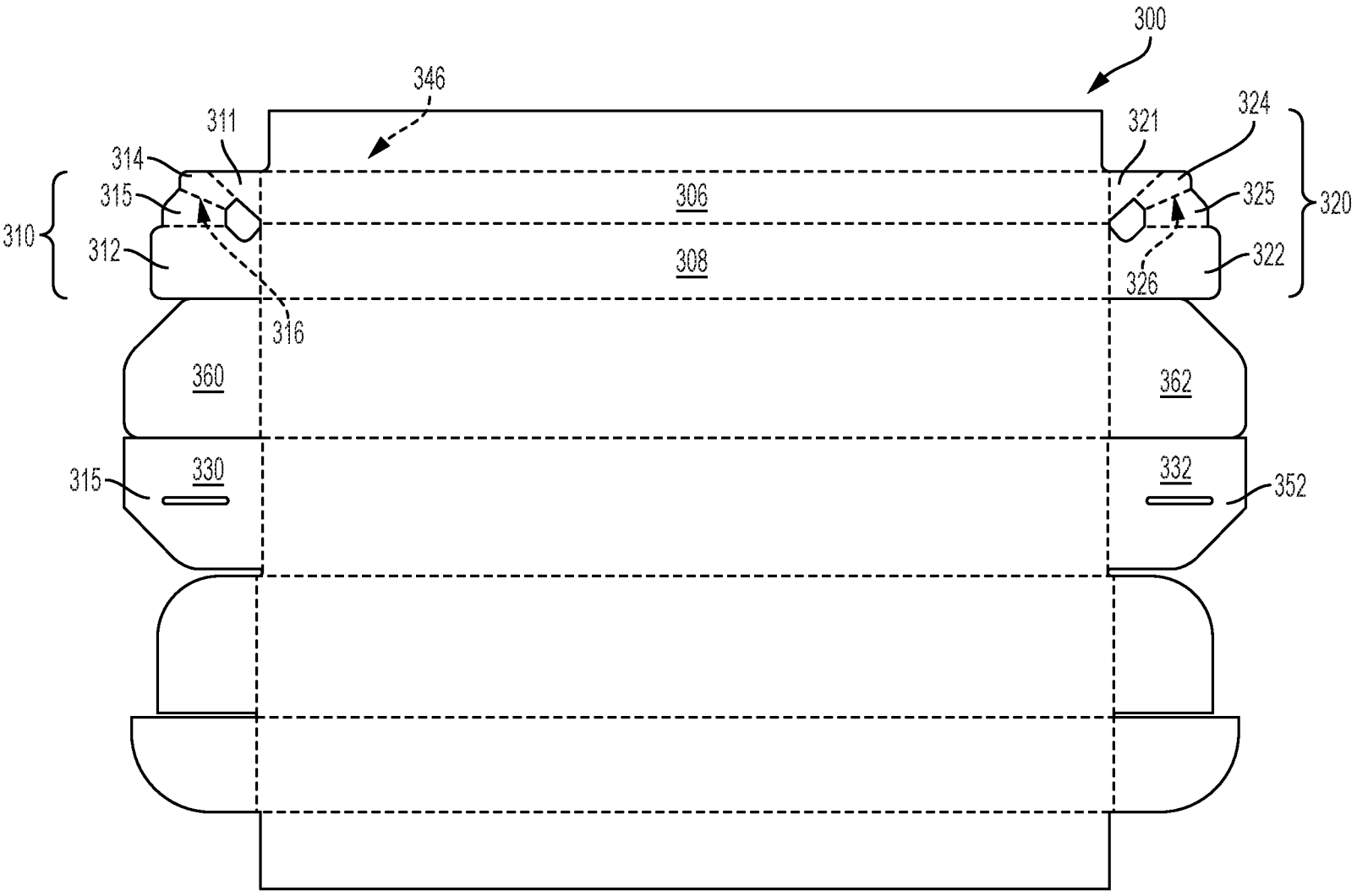
FIG. 29 is a plan view of an alternative embodiment of a blank for forming a container in accordance with the disclosed subject matter.

As further embodied herein, for purpose of illustration and not limitation, end locks can be formed from a blank 300, as shown in FIG. 29. The blank 300 can include the features of the blank 200 in addition with, or alternatively to, the further features described below. The blank 300 can include opposing first and second end lock tabs 310, 320 extending from opposing ends of a front angle panel 306 and a front base panel 308. Each end lock tab 310, 320 can include an end lock upper portion 311, 321, an end lock top slip 314, 324, an end lock bottom slip 315, 325, and an end lock lower portion 312, 322. Each end lock upper portion 311, 321 can extend from a fold line coextensive with the front angle panel 306 to a fold line coextensive with the end lock top slip 314, 324. Each end lock top slip 314, 324 can extend from the upper portion 311, 321 to an end lock free end 316, 326 coextensive with the end lock bottom slip 315, 325. Each end lock bottom slip 315, 325 can extend from the end lock free end 316, 326 to a fold line coextensive with each end lock lower portion 312, 322. Each end lock lower portion 312, 322 can extend from the end lock bottom slip 315, 325 to the front base panel 308. Each end lock tab 310, 320 can include an empty space 353, 354 between the end lock upper portion 311, 321, end lock top slip 314, 324, end lock bottom slip 315, 325, and end lock lower portion 312, 322.

Still referring to the blank 300 of FIG. 29, the blank 300 can additionally include slots 350, 351 located on each back side tab 330, 332. Each slot can be a narrow, horizontal cut out rounded at each end. The slots can be sized to fit the end lock free end 316, 326 therein when the blank 300 is formed into the container 100.

Referring again to FIG. 29, the front angle panel 306 can extend from the front angle base panel 308 to a front angle edge 346. The front angle edge 346 can extend horizontally between opposing end lock tabs 310 and 320. The front angle panel 306 can include no cut outs or can include substantially smaller cut outs as compared to the cut outs embodied in blank 200. Thus, when formed into the container 100, the front angle edge 346 can be secured on opposing ends of the container to allow for easy assembly of the end lock tabs 310 and 320. Securing the front angle edge 364 in this manner can also enhance the structural strength of the front angle panel 306, which keeps the panel at a consistent angle throughout repeated use. See for example, front angle edge 188, as shown in FIG. 1. The length of the front angle panel, defined from the front base panel 308 to the front angle edge 346, can be shorter than the corresponding length on the blank 200 of the front angle panel 206. This decreased length can increase accessibility to the roll in the container formed from the blank. The length can be decreased because the container 100 formed from the blank 300 can secure the roll with the end lock tabs 310, 320, as an alternative of, or in addition to, securing the roll with only the front angle panel 306.

Figure 30:
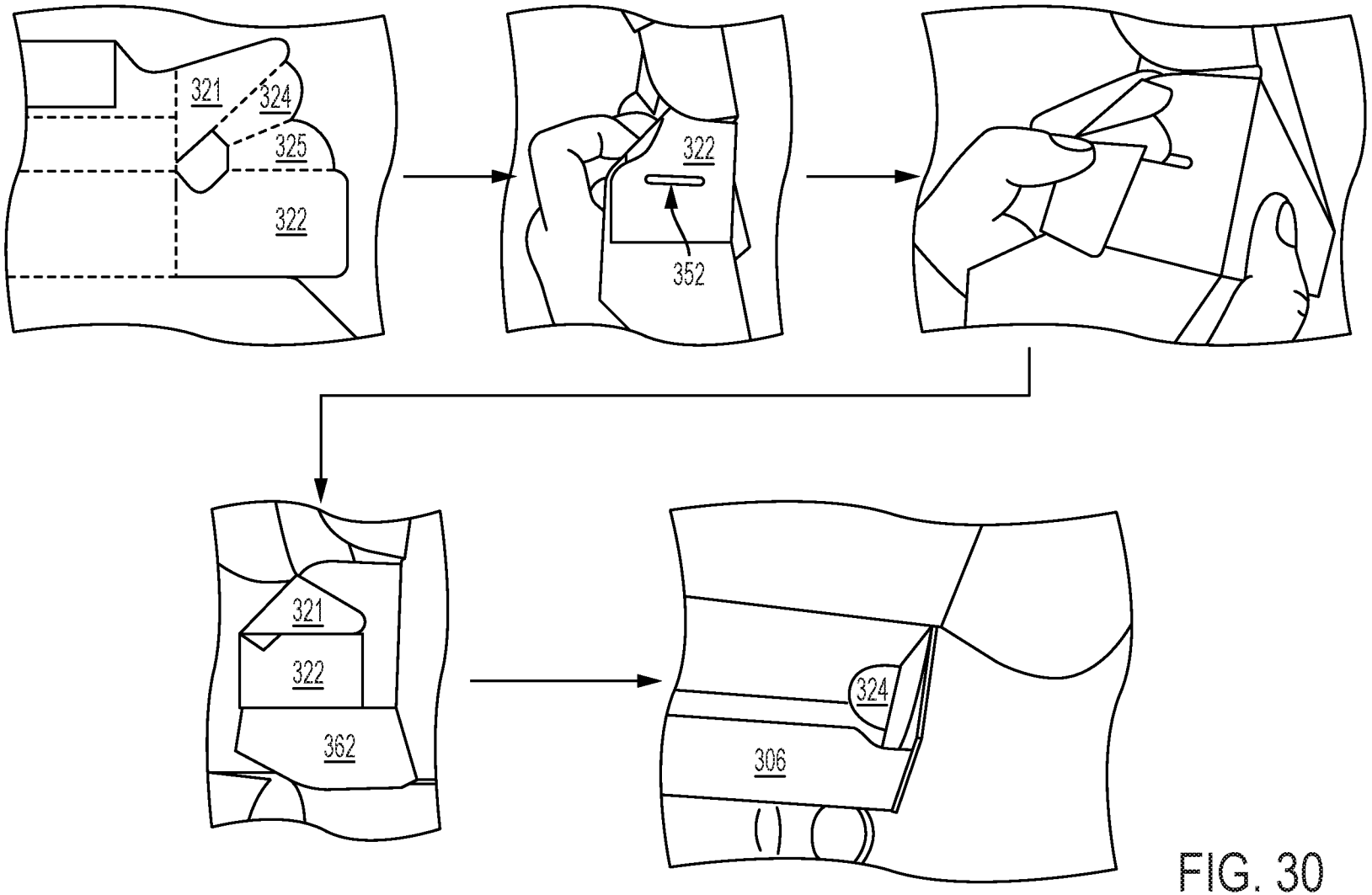
FIG. 30 is a schematic diagram illustrating sequentially folding the side panels of the erected blank of FIG. 29.

The blank 300 can be manufactured and erected in a similar manner as described above regarding the blank 200. As shown in FIG. 30, for purpose of illustration and not limitation, once the container is erected using any method, such as the methods previously described herein, the sides of the container 100 can be formed from the blank 300 by folding the end lock top slip 314, 324 onto the end lock bottom slip 315, 325 about the end lock free end 316, 326. The end lock free end 316, 326 can be inserted into the slot 351, 352 on the back side tabs 330, 332. Finally, the bottom side panel 360, 362 can fold onto the end lock tabs 310, 320 to secure the end lock upper portion 314, 324 and end lock lower portion 312, 322 against the back side tab 330, 332 using adhesive, or any other securing means. The embodied manufacturing method thus reduces the need for adhesive.

The container 100 and blank 200, 300 disclosed herein are preferably disposable, but the containers can be recycled or reused as desired. Additionally, the materials from which the container is made need not be the same throughout. The container and blank described herein can be manufactured from any suitable material, including but not limited to cardstock, pulp board, paperboard, micro-flute corrugated material, expanded polystyrene foam, oriented polystyrene (OPS), polypropylene, mineral filled polypropylene, amorphous polyethylene terephthalate (APET), thermoplastics, paper, recycled board, virgin board, or any other suitable material. As embodied herein, the container and blank can be manufactured from cardstock with about 18 to 22 points thickness or cardstock with a weight of about 350-450 grams per square meter. The blank of the disclosed subject matter can be retained in the assembled configuration, for example and without limitation, by adhesive bonding. Additionally or alternatively, the blank can be retained in the assembled configuration by tucking projecting portions of blank into slits provided and configured to clasp or otherwise engage such projecting portions. Additionally or alternatively, the container can be formed without the use of a blank, such as with an injection molded container. Other suitable additional or alternative retention means are within the scope of the disclosed subject matter.

It is to be recognized that the relative proportions of container 100 or blank 200 will vary according to the exact size and intended use of the container or blank. While an essentially rectangular container formed by a blank is herein described, one of ordinary skill in the art will recognize that any suitable shape and depth of the container and corresponding blank can be employed and the disclosed subject matter is not so limited. Other suitable shapes include cylinders, ovals, various polygons, etc., having any suitable relative proportions.

While the disclosed subject matter is described herein in terms of certain illustrations and examples, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for the purposes of illustration and description. It is not intended to be exhaustive or to limit the disclosed subject matter to those embodiments disclosed.

The description herein merely illustrates the principles of the disclosed subject matter. Various modifications and alterations to the described embodiments will be apparent to those skilled in the art in view of the teachings herein. Accordingly, the disclosure herein is intended to be illustrative, but not limiting, of the scope of the disclosed subject matter.

What is claimed is:

1. A container comprising a base portion defining a compartment and a lid portion moveable between an open position for access to the compartment and a closed position to cover the compartment;

the base portion comprising:

a bottom panel defining a bottom of the compartment, a front base panel extending upwardly from the bottom panel to a front angle panel, the front angle panel extending upwardly and inwardly from the front base panel to a free edge, a back panel extending from the bottom panel to a back panel upper edge to define an opening between the free edge and the back panel for access to the compartment, and first and second back side tabs extending from the back panel, first and second bottom side tabs extending from the bottom panel, and first and second front angle side tabs extending from the front angle panel, wherein the first front angle side tab is disposed between the first back side tab and the first bottom side tab to define a first side of the base portion, and the second front angle side tab is disposed between the second back side tab and the second bottom side tab to define an opposing second side of the base portion;

the lid portion comprising:

a top panel defining a top of the lid portion, the top panel hingedly-coupled to the upper edge of the back panel, a front lid panel extending downwardly from the top panel when the lid is in the closed position to a lid free end, and first and second top side panels extending from the top panel and defining opposing sides of the lid portion; and a cutter disposed on the front angle panel.

2. The container of claim 1, wherein the first and second back side tabs each have a front edge and a chamfered corner.

3. The container of claim 2, wherein the chamfered corner is at an angle of 10° to 90° relative to the front edge of the back side tab.

4. The container of claim 3, wherein the chamfered corner is at an angle of about 45° relative to the front edge of the back side tab.

5. The container of claim 2, wherein the chamfered corner of each back side tab engages the front angle panel.

6. The container of claim 1, wherein a roll of product is contained within the compartment.

7. The container of claim 6, wherein the product is plastic film wrap.

8. The container of claim 6, wherein the front angle panel is configured to retain the roll within the compartment.

9. The container of claim 8, wherein the front angle panel comprises at least one cut out corner for access to the product within the compartment.

10. The container of claim 6, further comprising end locks extending at least partially into the compartment from opposing sides of the base portion, wherein the end locks are configured to engage the inside of the roll and retain the roll within the compartment.

11. The container of claim 1, wherein the front angle panel comprises an intermediate portion disposed between the cutter and the free edge, and wherein the intermediate portion is joined proximate opposing ends thereof to the opposing sides of the base portion.

12. The container of claim 1, wherein, in the closed position, the cutter is disposed within a recess defined by the lid portion.

13. The container of claim 1, wherein the cutter comprises a track and a sliding member, wherein the track defines a channel, and wherein the sliding member is configured to slide within the channel of the track.

14. The container of claim 13, wherein the track comprises a detent and an end stop disposed within the channel, and wherein the detent is configured to inhibit or prevent movement of the sliding member along the track.

15. The container of claim 13, wherein the track comprises an end stop disposed at least partially within the channel, and wherein the end stop is configured to inhibit or prevent movement of the sliding member along the track beyond the end stop.

16. The container of claim 13, wherein the track has an upper surface with an adhesive coating disposed thereon, and wherein the adhesive coating is configured to releasably adhere to a sheet of a product removed from the compartment and disposed proximate the adhesive coating.

17. The container of claim 1, wherein the sliding member has lower portion sized to be disposed at least partially within the channel of the track, and wherein the lower portion has a rectangular shape.

18. The container of claim 1, wherein the container further comprises a frangible sticker coupled to the front lid panel and the front panel, wherein the frangible sticker comprises a perforation along its length, wherein in a first condition, the frangible sticker is configured to form a connection between the front lid panel and the front base panel with the lid portion in the closed position, and in a second condition, the frangible sticker is configured to allow the lid portion to be more toward the open position.

19. The container of claim 1, wherein the first back side tab includes a first slit and a first tab portion of the first front angle side tab extends at least partially through the first slit into the compartment, and further wherein the second back side tab includes a second slit and a second tab portion of the second front angle side tab extends at least partially through the second slit into the compartment.

* * * * *